US009574853B2

(12) United States Patent
Crispin

(10) Patent No.: US 9,574,853 B2
(45) Date of Patent: Feb. 21, 2017

(54) REMOVABLE AIMING SIGHT AND SIGHT MOUNTING SHOE WITH PITCH AND YAW ADJUSTMENT FOR PISTOLS AND OTHER WEAPONS

(71) Applicant: Leupold & Stevens, Inc., Beaverton, OR (US)

(72) Inventor: Quint Crispin, Beaverton, OR (US)

(73) Assignee: Leupold & Stevens, Inc., Beaverton, OR (US)

( * ) Notice: Subject to any disclaimer, the term of this patent is extended or adjusted under 35 U.S.C. 154(b) by 0 days.

(21) Appl. No.: 14/596,105

(22) Filed: Jan. 13, 2015

(65) Prior Publication Data

US 2015/0198421 A1 Jul. 16, 2015

Related U.S. Application Data

(60) Provisional application No. 62/025,422, filed on Jul. 16, 2014, provisional application No. 61/926,764, filed on Jan. 13, 2014.

(51) Int. Cl.
*F41A 11/00* (2006.01)
*F41G 11/00* (2006.01)
*F41G 1/16* (2006.01)

(52) U.S. Cl.
CPC ..... *F41G 11/006* (2013.01); *F41G 11/007* (2013.01); *F41G 1/16* (2013.01)

(58) Field of Classification Search
CPC ..... F41G 1/00; F41G 1/16; F41G 1/387; F41G 1/393; F41G 1/38; F41G 11/00; F41G 11/001; F41G 11/005; F41G 11/006; F41G 11/007
USPC ..... 42/111, 119, 124, 125, 126, 135, 136,42/137
See application file for complete search history.

(56) References Cited

U.S. PATENT DOCUMENTS 3,553,843 A * 1/1971 Sophinos et al. ..... F41G 1/48 42/105
3,979,848 A 9/1976 Ackerman, Jr.
4,742,636 A * 5/1988 Swan ..... F41G 11/006 42/126
5,070,637 A 12/1991 French
5,467,552 A 11/1995 Cupp et al.
6,568,118 B1 * 5/2003 Teetzel ..... F41G 1/36 42/105
6,594,937 B2 * 7/2003 Weichert ..... F41G 1/16 42/105

(Continued)

*Primary Examiner* — Jonathan C Weber
(74) *Attorney, Agent, or Firm* — Stoel Rives LLP

(57) ABSTRACT

A sight mount system for preserving adjustment settings of a removable aiming sight so as to avoid disturbing the point of aim of the aiming sight when the aiming sight is removed and subsequently reinstalled on a projectile weapon. The system includes an aiming sight foot supporting the aiming sight and a sight mount shoe for receiving the aiming sight foot. The sight mount shoe includes a non-adjustable datum surface, and pitch and yaw adjustment mechanisms that cooperate with the datum surface to establish the pitch and yaw of the aiming sight when the aiming sight foot is secured in the sight mount shoe. A foot retainer urges the aiming sight foot into contact with the datum surface and the pitch and yaw adjustment mechanisms, the foot retainer being manually operable to enable removal and reinstallation of the aiming sight foot without disturbing the pitch and yaw adjustment mechanisms.

11 Claims, 19 Drawing Sheets

(56) References Cited

U.S. PATENT DOCUMENTS

| | | | | |
|---|---|---|---|---|
| 6,622,415 | B1 | 9/2003 | Canaday et al. | |
| 7,204,052 | B2 | 4/2007 | Swan | |
| 7,526,890 | B1 | 5/2009 | Keng et al. | |
| 7,647,720 | B1 * | 1/2010 | Vendetti | F41G 1/28 42/126 |
| 8,151,510 | B2 | 4/2012 | Capson | |
| 8,240,075 | B1 * | 8/2012 | Mullin | F41G 1/38 42/119 |
| 8,407,924 | B2 * | 4/2013 | Lee | F41G 1/473 42/111 |
| 8,448,374 | B2 | 5/2013 | Samson et al. | |
| 8,468,735 | B1 | 6/2013 | Keng et al. | |
| D721,781 | S | 1/2015 | Larsson | |
| 2006/0179704 | A1 * | 8/2006 | Dextraze | F41G 1/393 42/126 |
| 2011/0154713 | A1 * | 6/2011 | Jung | F41G 1/30 42/137 |
| 2013/0074394 | A1 | 3/2013 | Larue | |
| 2013/0180152 | A1 | 7/2013 | Speroni | |
| 2014/0305022 | A1 | 10/2014 | Chung | |
| 2015/0377591 | A1 | 12/2015 | Dentler | |

* cited by examiner

REMOVABLE AIMING SIGHT AND SIGHT MOUNTING SHOE WITH PITCH AND YAW ADJUSTMENT FOR PISTOLS AND OTHER WEAPONS

RELATED APPLICATIONS

This application claims priority to and the benefit under 35 U.S.C. §119(e) of U.S. Provisional Patent Application No. 61/926,764, filed Jan. 13, 2014, and of U.S. Provisional Patent Application No. 62/025,422, filed Jul. 16, 2014, the disclosures of which are incorporated herein by reference.

TECHNICAL FIELD

The present disclosure relates generally to mounting systems for riflescopes, reflex sights, or other aiming devices suitable for viewing distant targets or objects. In particular, the present disclosure relates to such mounting systems having adjustment features for aligning removable aiming devices.

BACKGROUND

Aiming devices, such as riflescopes and reflex sights, are used with projectile weapons to aid viewing and tracking a distant object. Some aiming devices may include magnification features that allow a user to optically magnify distant targets, which may make the target easier to resolve. However, magnification of the distant object results in a narrow field of view, which may make it difficult to track movement of the distant target using the aiming device. Other sights may provide no additional magnification, thereby providing a comparatively wider field of view.

A user may decide to use a magnified or a non-magnified aiming device depending on the shooting environment, shooting conditions, visibility, and the distance between the shooter and the target, among other variables. On some occasions, such as when shooting conditions change on the field, a user may wish to swap between a magnified and non-magnified aiming devices. On other occasions, a user may remove the aiming sight from the projectile weapon for other purposes, such as for maintenance and/or repair, and subsequently reinstall the aiming sight. Typically, when the aiming device is removed from the projectile weapon, the adjustment settings (e.g., the horizontal and vertical aiming settings) are lost, which requires the user to readjust the settings after the aiming device is reinstalled.

The present inventor has identified a need for an improved sight mount system that preserves adjustment settings of an aiming device so as to avoid disturbing the point of aim of the aiming device when the aiming device is removed and subsequently reinstalled. Additional aspects and advantages will be apparent from the following detailed description of example embodiments, which proceeds with reference to the accompanying drawings.

DETAILED DESCRIPTION OF EXAMPLE EMBODIMENTS

This section describes particular embodiments and their detailed construction and operation. The embodiments described herein are set forth by way of illustration only and not limitation. Throughout the specification, reference to "one embodiment," "an embodiment," or "some embodiments" are not necessarily all referring to the same embodiment. The described features, structures, characteristics, and methods of operation may be practiced in isolation or combined in any suitable manner, and can be practiced without one or more of the specific details or with other methods, components, materials, or the like. In other instances, well-known structures, materials, or methods of operation are not shown or not described in detail to avoid obscuring more pertinent aspects of the embodiments.

FIGS. 1-7 collectively illustrate example embodiments of sight mount systems 100, 200 that may be used for aligning a removable aiming sight for a projectile weapon to a selected mounting adjustment preserved in a sight mount shoe. With particular reference to the embodiment illustrated in FIG. 2, aiming sight foot 202 supports an aiming sight 204 so that the sight 204 may be repeatedly reinstalled on sight mount shoe 206 without substantially altering the point of aim for aiming sight 204 stored by an adjustment mechanism in the shoe 206. For ease of illustration, the examples of aiming sight 204 described herein generally relate to a reflex sight, sometimes referred to as a "red dot" sight. Reflex sights often position a source for the aiming point, such as an illuminated "dot" or reticle, at or near a focal point of a partially reflective optic that transmits some light received from the distant object and reflects some light received from the source. Nevertheless, it will be understood that some embodiments of aiming sight 204 may range from those as simple as an iron sight to those as complex as a telescopic sight. Additional details of these and other embodiments are described below with reference to the figures.

Figure 1:
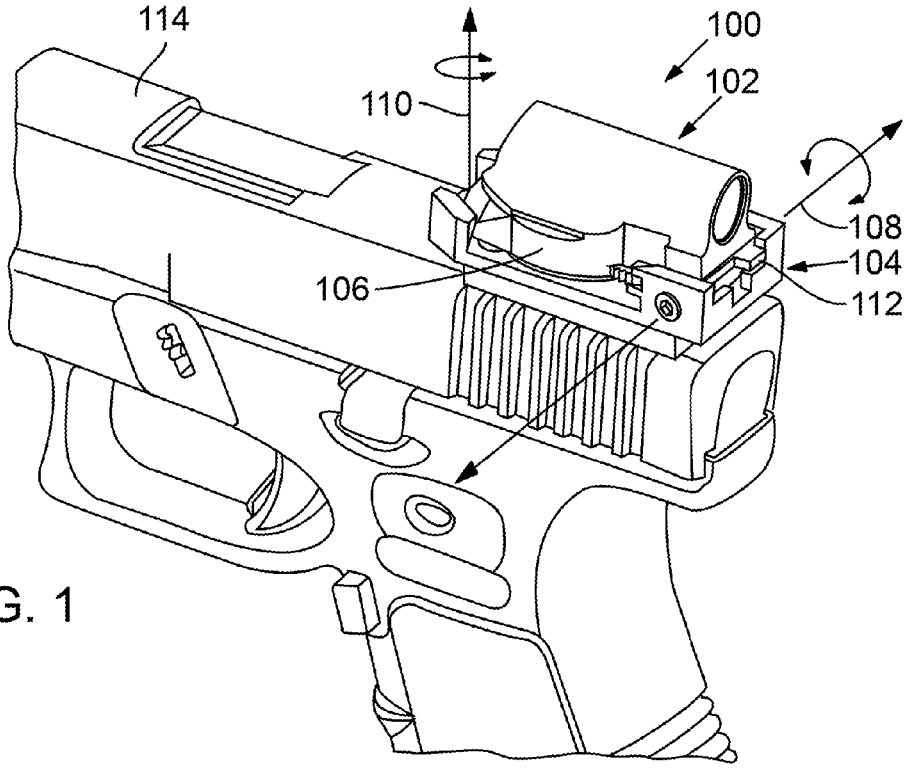
FIG. 1 is a top perspective view of an embodiment of a sight mount system for a projectile weapon.

FIG. 1 illustrates an embodiment of a sight mount system 100 for aligning a removable aiming sight 102 to a selected mounting adjustment or point of aim preserved by a sight mount shoe 104. Aiming sight 102 is supported by an aiming sight foot 106, which may be a separate piece from aiming sight 102 or which may be integrated therewith. Sight mount shoe 104 has an adjustment mechanism operative to adjust the pitch and the yaw of aiming sight 102 by rotating aiming sight foot 106 about a pitch axis 108, a yaw axis 110, or both. A retainer 112 couples aiming sight foot 106 to sight mount shoe 104, and is manually operable to enable aiming sight 102 to be removed and reinstalled on the shoe while preserving the pitch and yaw orientation of the sight so that neither the pitch nor the yaw is substantially altered by more than the precision or leeway of the adjustment mechanism. Further, once removed from sight mount shoe 104, aiming sight 102 may be installed on a different shoe and become aligned to the mounting adjustment for that shoe. Later, aiming sight 102 may be reinstalled on sight mount shoe 104 and restored to the settings preserved therein.

For clarity, various directions and orientations described herein are made with reference to sight mount shoe 104 as supported from below by projectile weapon 114, as shown in the embodiment depicted in FIG. 1, for example, though some embodiments may be supported or mounted from a side or some other surface of a weapon without departing from the scope of this disclosure.

Figure 3:
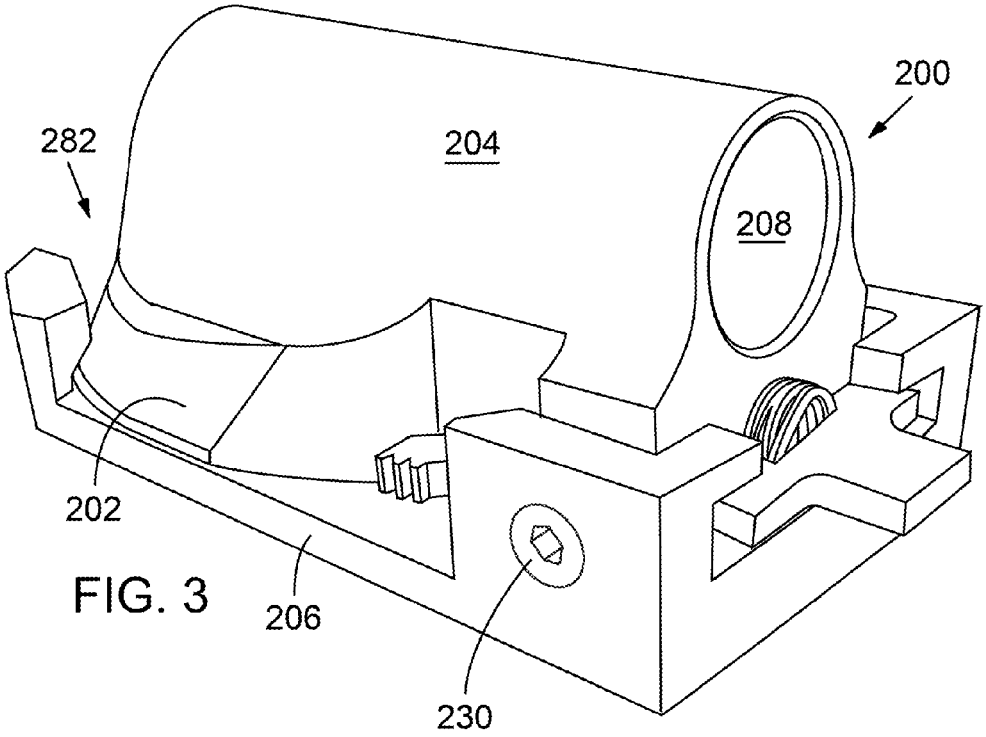
FIG. 3 is a rear perspective view of the embodiment shown in FIG. 2.
Figure 2:
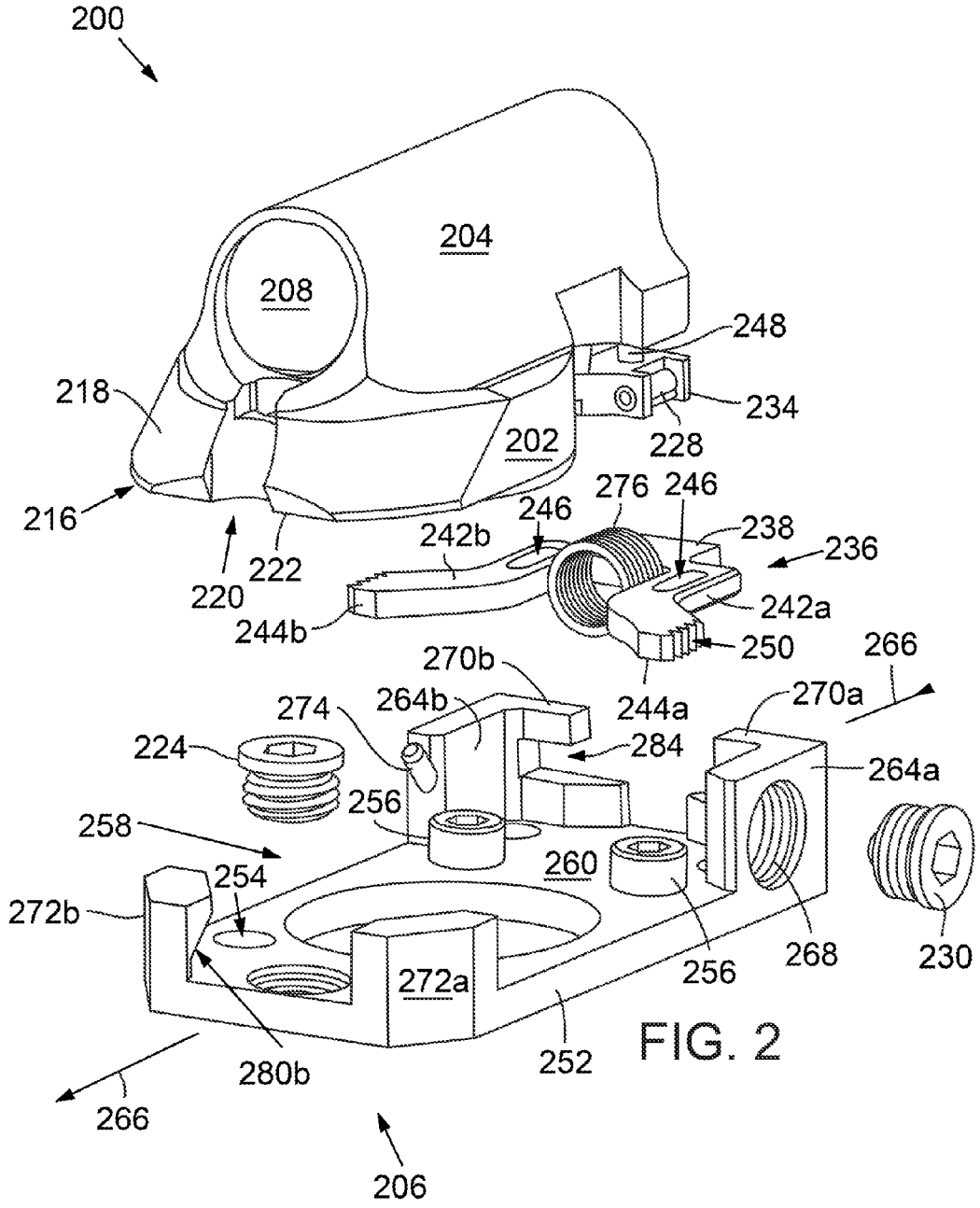
FIG. 2 is a top exploded view of another embodiment of a sight mount system for a projectile weapon.

FIGS. 2 and 3 illustrate another embodiment of a sight mount system 200.

With particular reference to FIG. 2, aiming sight 204 includes optics 208 and a light source 210. In the depicted embodiment, aiming sight 204 is enclosed to prevent exposure of the optics 208 and electronics to the external environment. Light source 210 is shown powered by an onboard power supply 212 that is accessible via a resealable maintenance port 214. In some embodiments, onboard power supply 212 may include a battery. Alternatively, in some embodiments aiming sight 204 may be powered from a remote power source via electrical communication with a conductor included in sight mount shoe 206.

Aiming sight foot 202 includes a toe 216 that projects forward from the front of aiming sight foot 202 to provide at least one point of contact with sight mount shoe 206 along a hoof-shaped curved surface 218, as explained in more detail below with reference to FIG. 7. In some embodiments, curved surface 218 may include an opening 220 or may otherwise be divided or recessed so that a pitch adjustment tool may be inserted through or within toe 216 to vary a pitch adjustment located in sight mount shoe 206.

On the underside of toe 216 is a pitch bearing surface 222 (shown near opening 220 in FIG. 2). Pitch bearing surface 222 is adapted to rest on a pitch adjustment mechanism 224 (described in more detail below) that is included in sight mount shoe 206 and transmit a force from pitch adjustment mechanism 224 to toe 216 and thus adjust the pitch of aiming sight 204 about a pitch axis 226 (see FIG. 7).

Figure 4:
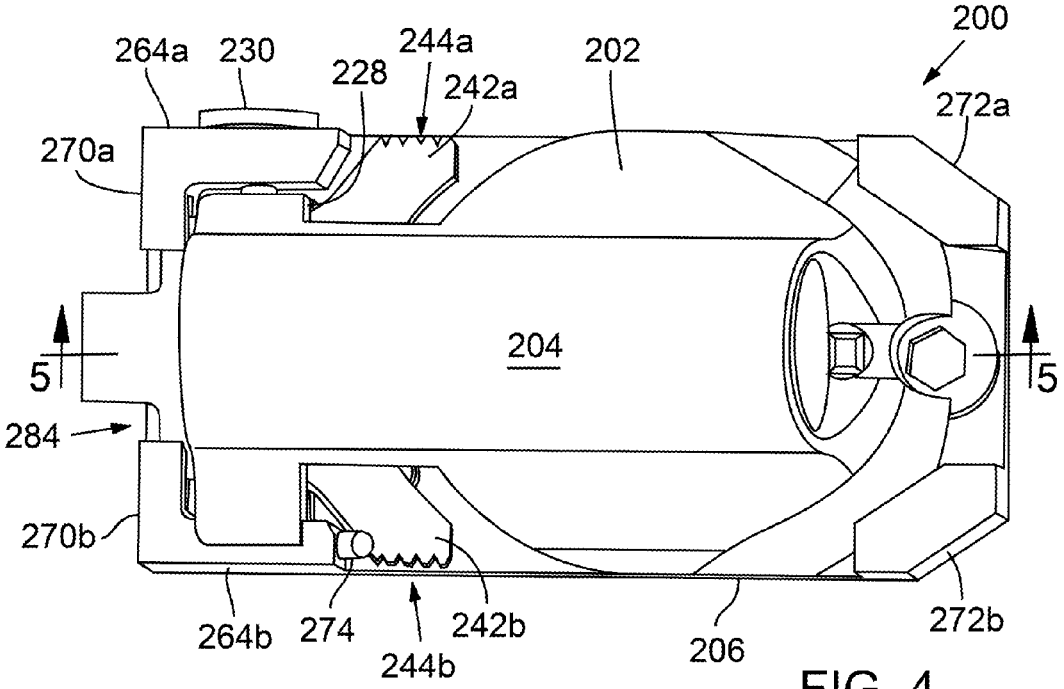
FIG. 4 is a top view of the embodiment shown in FIG. 2.
Figure 6:
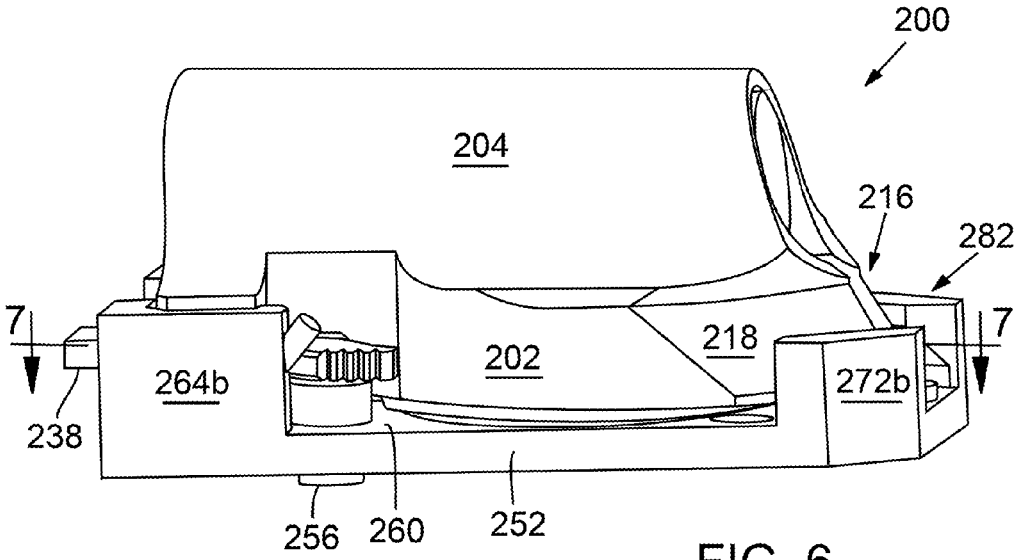
FIG. 6 is a right side view of the embodiment shown in FIG. 2.
Figure 5:
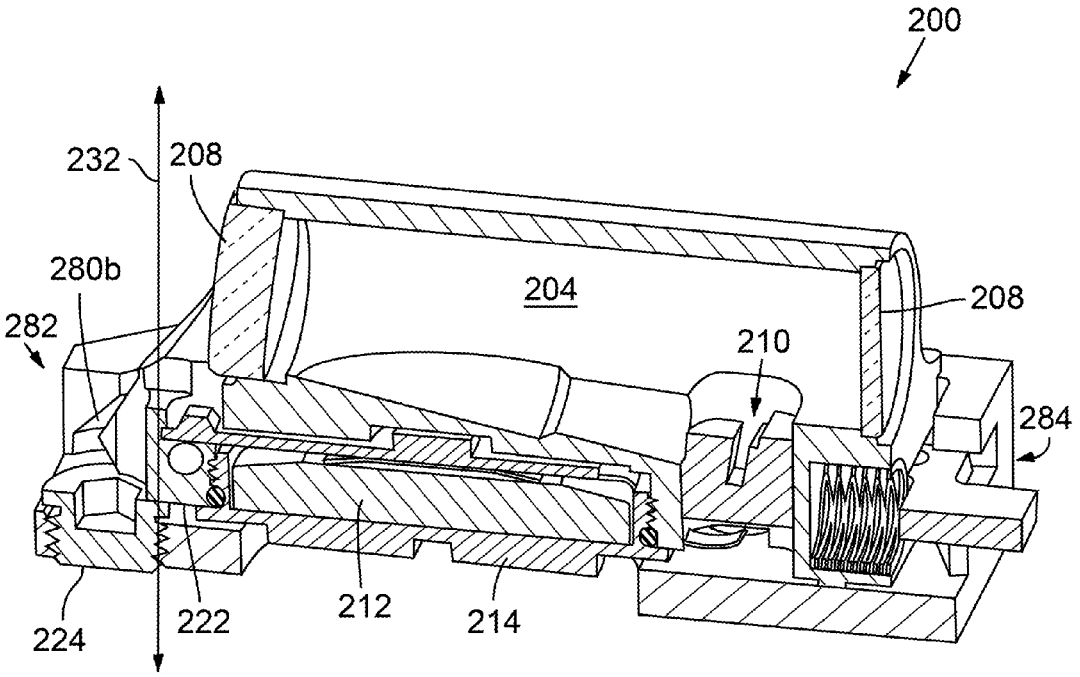
FIG. 5 is a side sectional view taken along line 5-5 of the embodiment shown in FIG. 4.

With particular reference to FIGS. 2 and 4, aiming sight foot 202 includes a yaw bearing surface 228 located rearward of pitch bearing surface 222. Yaw bearing surface 228 transmits forces from a yaw adjustment mechanism 230 into aiming sight foot 202 to adjust the yaw of aiming sight 204 about a yaw axis 232 (see FIG. 5) that is perpendicular to pitch axis 226. In some embodiments, yaw bearing surface 228 may be mounted on or otherwise coupled to supports 234.

Aiming sight foot 202 includes a foot retainer 236 that couples aiming sight foot 202 to sight mount shoe 206. Foot retainer 236 is interposed between aiming sight foot 202 and sight mount shoe 206 to cause aiming sight foot 202, and aiming sight 204 mounted thereon, to be self-aligned to sight mount shoe 206 by a selected pitch and yaw, as described in more detail below. With particular reference to FIGS. 2 and 7, foot retainer 236 includes a shank 238 extending to a crossbar 240. A pair of arms 242*a*, 242*b* extend forwardly from the crossbar 240 toward the toe 216 and includes a pair of ends 244*a*, 244*b* that splay outwardly into a roughly Y-shape. Arms 242*a*, 242*b* each include a slot 246 formed thereon and adapted to receive a complementary post 248 to retain foot retainer 236 against aiming sight foot 202. Slots 246 are elongated to accommodate forward and rearward travel of the foot retainer 236 relative to the aiming sight 202. In some embodiments, the ends 244*a*, 244*b* may include teeth 250 formed at an end thereof to provide traction for gripping foot retainer 236 during installation and removal in sight mount shoe 206, as described in more detail below.

Figure 7:
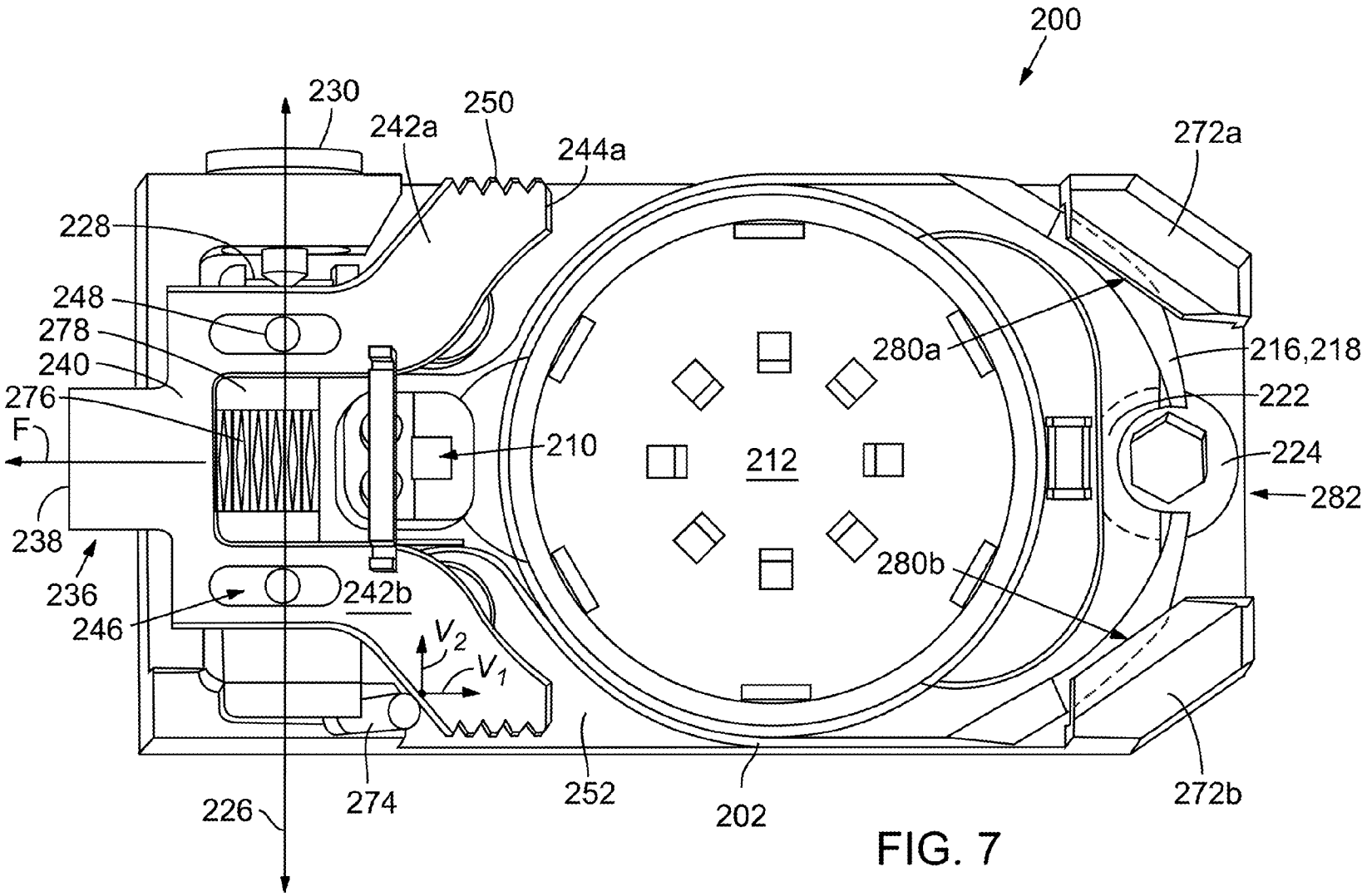
FIG. 7 is a top sectional view taken along line 7-7 of the embodiment shown in FIG. 6.
Figure 8:
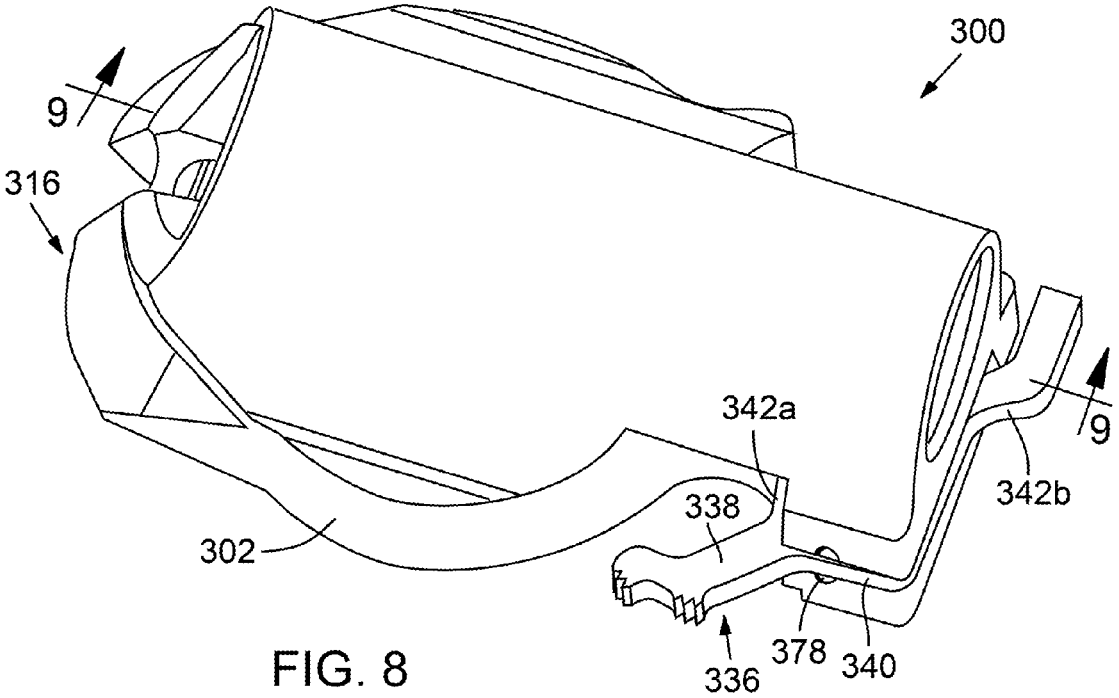
FIG. 8 is a top perspective view of an example of an aiming sight foot for use with another embodiment of a sight mount system.

With particular reference to FIGS. 2, 4, and 7, sight mount shoe 206 is carried or supported by a baseplate 252, which is secured to the weapon (shown at 106 in FIG. 1) by inserting alignment tabs (not shown) on the weapon into openings 254 and installing bolts 256 in baseplate 252 to connect the weapon to sight mount shoe 206. In some embodiments, baseplate 252 may include a centrally located interior opening (not shown) that provides clearance for port 214 when the foot is installed on sight mount shoe 206.

When installed, aiming sight foot 202 occupies an interior region 258 of sight mount shoe 206. Interior region 258 is defined by various walls and surfaces, described below, which extend or protrude from an outer surface 260 that faces away from the weapon. A bottom of interior region 258 is defined by outer surface 260, and includes pitch adjustment mechanism 224. Rotation of pitch adjustment mechanism 224 within an opening 262 in baseplate 252 moves pitch adjustment mechanism 224 in and out of the baseplate 252 and allows the pitch of aiming sight foot 202 to be adjusted about pitch axis 226 when installed in sight mount shoe 206. In one non-limiting example, pitch adjustment mechanism 224 may provide up to about 100 minutes of angle (MOA) of adjustment, while other examples may provide more or less than 100 MOA of adjustment. In some embodiments, pitch axis 226 may pass through yaw adjustment mechanism 230 (see FIG. 7). In the illustrated embodiment, the pitch adjustment mechanism 224 is shown including an adjustment screw, but it will be appreciated that adjustment slides, wedges, cams, or other suitable structures may be included without departing from the scope of the present disclosure. In some embodiments, an adjustment to the pitch may act as a surrogate for a vertical component (e.g., an elevation adjustment) of the point of aim.

With particular reference to FIG. 2, sidewalls 264*a*, 264*b* extend upwardly from the outer surface 260 of the baseplate 252 and are positioned on a left and right side, respectively, of an aiming centerline 266 of the sight mount shoe 206, thereby defining left and right boundaries of the interior region 258. Sidewall 264*a* includes yaw adjustment mechanism 230, which is threaded into an opening 268 that traverses sidewall 264*a*. Similar to pitch adjustment mechanism 224, rotation of yaw adjustment mechanism 230 within opening 268 moves yaw adjustment mechanism 230 in and out of sidewall 264*a* to adjust the yaw of aiming sight foot 202 about yaw axis 232 when installed in the shoe 206. Also similar to pitch adjustment mechanism 224, in one non-limiting example, yaw adjustment mechanism 230 may provide up to about 100 MOA of adjustment, while other examples may provide more or less than 100 MOA of adjustment. In some embodiments, yaw axis 232 may pass through pitch adjustment mechanism 224 (see FIG. 5). While yaw adjustment mechanism 230 is shown including an adjustment screw, it will be appreciated that adjustment knobs, slides, wedges, cams, or other suitable structures may be included without departing from the scope of the present disclosure. In some embodiments, an adjustment to the yaw may act as a surrogate for a horizontal component (e.g., a windage adjustment) of the point of aim.

A rear boundary of interior region 258 is defined by a pair of mutually spaced apart bulkhead walls 270*a*, 270*b* that extend upwardly from a rear portion of baseplate 252. In some embodiments, one or both sidewalls 264*a*, 264*b* may be joined with respective bulkhead walls 270*a*, 270*b*. In some embodiments, a single bulkhead wall 270 may be provided. A front boundary of interior region 258 is defined by two mutually spaced apart toe walls 272*a*, 272*b* that extend upwardly from a front portion of baseplate 252. While two toe walls 272*a*, 272*b* may be included in some embodiments, it will be appreciated that some embodiments may include three or more toe walls, while other embodiments may include a single toe wall.

As explained in more detail below with reference to FIGS. 2 and 7, when the foot 202 is installed in the shoe 206, pitch adjustment mechanism 224 and yaw adjustment mechanism 230 are held against respective pitch and yaw bearing surfaces 222, 228 as a result of a reaction of a force exerted by foot retainer 236 against a force direction surface 274. Force direction surface 274 acts as a datum, or defined reference surface, so that when foot retainer 236 couples pitch bearing surface 222 and yaw bearing surface 228 with their respective pitch and yaw adjustment mechanisms 224, 230, the interaction of force direction surface 274 with foot retainer 236 urges aiming sight foot 202 to assume the selected pitch and yaw relative to sight mount shoe 206. In some embodiments, force direction surface 274 may extend upwardly and/or obliquely relative to baseplate 252. In one non-limiting example, force direction surface 274 may include a pin extending upwardly from a front surface of sidewall 264*b* at a 45-degree angle. In turn, aiming sight 204 is aligned to the pitch and yaw settings preserved in sight mount shoe 206, and may be repeatedly removed and aligned without disturbing those settings.

Aiming sight foot 202, and thus aiming sight 204, may be installed on sight mount shoe 206 by grasping arms 242*a*, 242*b* of the shank 238 and drawing foot retainer 236 toward toe 216 while the sight 204 is disconnected from the shoe 206. This action loads a compression spring 276 (e.g., a wave spring) which occupies a gap 278 between arms 242*a*, 242*b*, crossbar 240, and aiming sight foot 202 (see FIG. 7). Thereafter, the aiming sight foot 202 is placed into interior region 258 of sight mount shoe 206. Toe 216 is placed near or against toe walls 272*a*, 272*b*, so that curved surface 218 is positioned in a vicinity of non-adjustable toe sliding surfaces 280*a*, 280*b* formed on an interior surface of toe walls 272*a*, 272*b* facing interior region 258. Toe sliding surfaces 280*a*, 280*b* exhibit a smooth undercut or recessed profile to form a toe cap 282. In some embodiments, toe 216 may make contact with toe sliding surfaces 280*a*, 280*b* at two locations. In other embodiments, a single point of contact may be made between the two structures. In still other embodiments, toe 216 may make contact with toe sliding surfaces 280*a*, 280*b* at three or more locations. In some embodiments, toe sliding surfaces 280*a*, 280*b* may be arranged at an angle with one another, while in some other embodiments they may parallel one another. Pitch adjustment mechanism 224 is spaced apart from and cooperates with toe sliding surfaces 280*a*, 280*b* to selectively define a pitch orientation of toe 216 about pitch axis 226.

Arms 242*a*, 242*b* are moved toward the rear of aiming sight foot 202 so that shank 238 extends through a release opening 284 formed by bulkhead walls 270*a*, 270*b* and arm 242*b* bears against force direction surface 274, leaving spring 276 partially compressed. When aiming sight foot 202 is installed on sight mount shoe 206, the force of spring 276 causes arm 242*b* to bear against force direction surface 274. The resulting reaction causes pitch bearing surface 222 and yaw bearing surface 228 to couple with pitch adjustment mechanism 224 and yaw adjustment mechanism 230, respectively. With particular reference to FIG. 7, force direction surface 274 cooperates with foot retainer 236 to transform the spring force, shown as F, into at least two orthogonal force vectors, shown as $V_1$ and $V_2$. One force vector ($V_1$) is directed forward, pressing curved surface 218 into toe sliding surfaces 280*a*, 280*b*. As toe 216 is urged forward against toe sliding surfaces 280*a*, 280*b*, toe 216 follows the undercut profile of toe sliding surfaces 280*a*, 280*b* downward toward baseplate 252, driving pitch bearing surface 222, and thus aiming sight foot 202 against pitch adjustment mechanism 224. Another force vector ($V_2$) is directed orthogonally to the first vector to keep yaw bearing surface 228 pressed against a yaw adjustment mechanism 230. In turn, aiming sight foot 202 assumes, relative to sight mount shoe 206, the pitch and yaw selected by the adjustment mechanisms.

In some embodiments, the pitch and yaw of aiming sight foot 202 may be adjusted after installation on sight mount shoe 206. Because force direction surface 274 and arm 242*b* are both angled, arm 242*b* may slide against force direction surface 274 as adjustments are made via pitch and/or yaw adjustment mechanisms 224, 230. For example, translation of pitch adjustment mechanism 224 in and/or out of baseplate 252 when aiming sight foot 202 is installed adjusts the height of pitch adjustment mechanism 224. As pitch adjustment mechanism 224 bears against pitch bearing surface 222, toe 216 will slide or slip against toe sliding surfaces 280*a*, 280*b* so that toe 216 slips against toe cap 282. In turn, aiming sight foot 202 moves rearward. Arm 242*b* may help stabilize or equalize the force vectors within the system so that aiming sight 204 pivots about pitch axis 226 without disturbing contact between yaw bearing surface 228 and yaw adjustment mechanism 230. Of course, it will be understood that movement of the yaw adjustment mechanism alone may result in adjustment about the yaw axis without disturbing the connection between the pitch bearing surface and the pitch adjustment mechanism. Accordingly, aiming sight foot 202 may maintain contact with the adjustment mechanisms under the urging of spring 276 and the cooperative relationships described herein so that aiming sight 204 may be moved in either axis independently or together.

It is not necessary that force direction surface 274 be positioned in any particular angle. The angle at which force direction surface 274 extends relative to baseplate 252 may determine, at least in part, the magnitude of the force that is transferred by the resulting force vectors. For example, as the angle increases and force direction surface 274 becomes more upright (i.e., more normal to baseplate 252), more force may be transferred to aiming sight foot 202, potentially making the coupling between the foot and the shoe more secure and more resistant to recoil forces. Conversely, as force direction surface 274 becomes more reclined with respect to baseplate 252, less force may be transferred to aiming sight foot 202, potentially making it easier to release and install the foot 202 on the shoe 206. Thus, in some embodiments, an angle between force direction surface 274 and baseplate 252 may be variable, so that a user might establish or lock force direction surface 274 in one position (e.g., during use) and later move force direction surface 274 to a different position (e.g., to ease removal and/or subsequent installation).

The aiming sight foot 202 may be removed from sight mount shoe 206 by reversing the installation steps described previously. For example, with general reference to FIG. 4, in one removal process, the shank 238 is moved forward toward the interior region 258 of the baseplate 252 until clearing release opening 284 by pressing the shank 238 and/or moving arms 242*a*, 242*b*. Once shank 238 is fully within interior region 258, toe 216 is withdrawn from toe cap 282 and aiming sight foot 202 is separated from baseplate 252. Although aiming sight 204 is now free and clear of sight mount shoe 206, the selected pitch and yaw settings are retained by the respective pitch and yaw adjustment mechanisms 224, 230. Thus, aiming sight foot 202, and aiming sight 204 mounted thereon, may be reinstalled on any suitable sight mount shoe 206 and, on installation, become aligned to the point of aim held therein by pitch adjustment mechanism 224 and yaw adjustment mechanism 230.

It should be understood that the cooperative relationships among the structures that transfer forces while preserving pitch and yaw settings of the aiming sight 204 are not limited to the embodiments described above with reference to FIGS. 2-7. In other embodiments, a different configuration for a sight mount system may be used. For example, FIGS. 8-11 collectively illustrate another embodiment of a sight mount system 300. In FIGS. 8-11, the reference numbers having the same final two digits as those in FIGS. 2-7, as preceded by the number "3," identify analogous structures. For example, reference number 302 in FIG. 8 identifies an aiming sight foot similar to aiming sight foot 202 in FIG. 2. Accordingly, some detail of these structures may not be further described to avoid obscuring more pertinent aspects of the embodiment.

Figure 10:
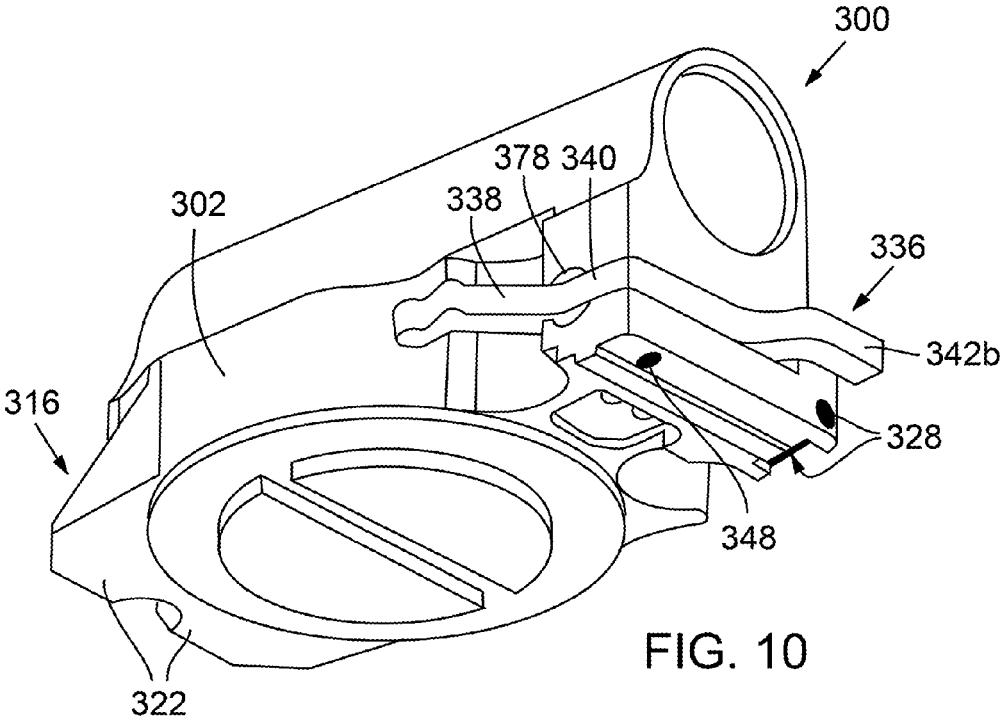
FIG. 10 is a bottom perspective view of the embodiment shown in FIG. 8.
Figure 9:
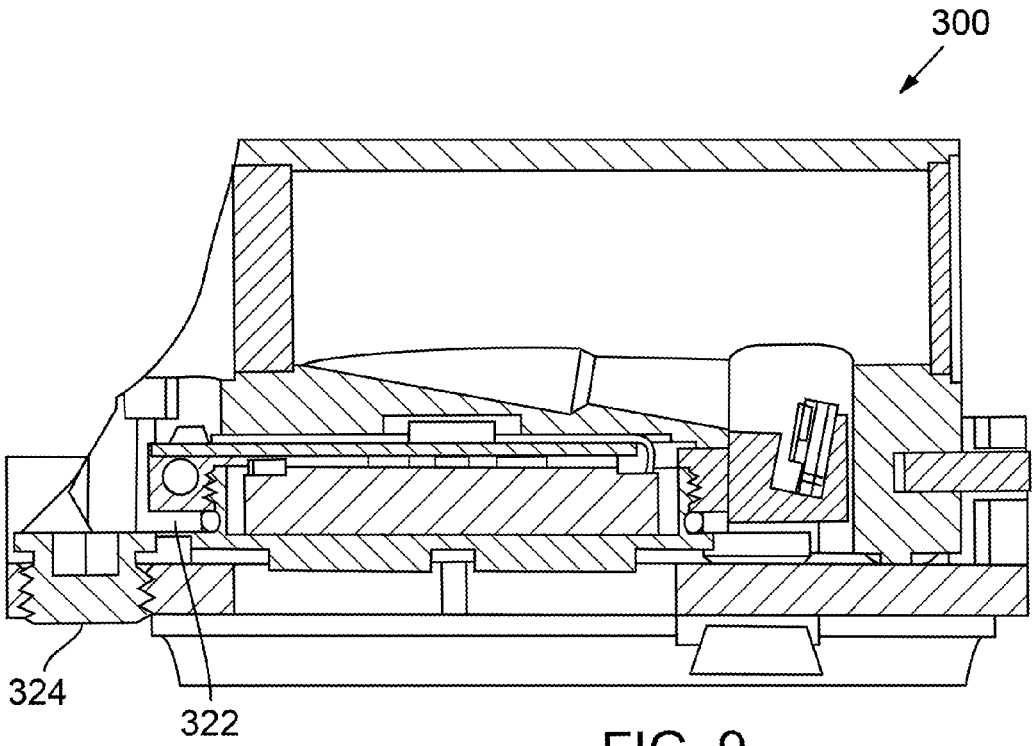
FIG. 9 is side sectional view taken along line 9-9 of the embodiment shown in FIG. 8.
Figure 11:
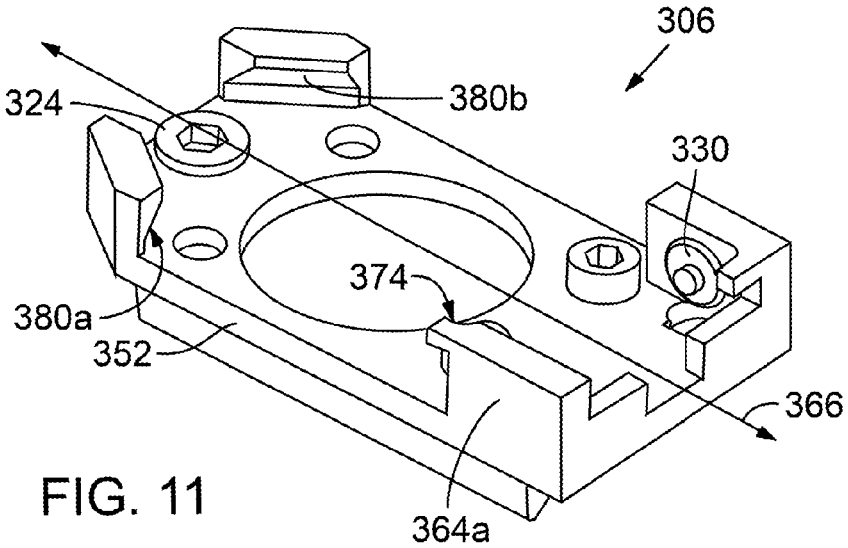
FIG. 11 is a top perspective view of an example of a sight mount shoe for use with the embodiment of the aiming sight foot shown in FIG. 8.

With particular reference to FIGS. 10 and 11, aiming sight foot 302 includes a foot retainer 336 that has a shank 338 extending to a crossbar 340 which connects two arms 342*a*, 342*b*. Foot retainer 336 is carried by aiming sight foot 302 and is held thereon by a post 348 that fits within a complementary slot (not shown) formed in the arm 342*b*, so that foot retainer 336 may travel back and forth relative to aiming sight 302. A spring (not shown) occupies a gap 378 between crossbar 340 and aiming sight foot 302 to bias the foot away from foot retainer 336.

When aiming sight foot 302 is installed on sight mount shoe 306, the spring urges movement of the foot retainer 336 laterally, relative to an aiming centerline 366 of the shoe when installed therein, against a force direction surface 374 recessed into sidewall 364*a*, causing foot retainer 336 to force yaw bearing surface 328 against yaw adjustment mechanism 330. The reaction between foot retainer 336 and force direction surface 374 also forces toe 316 into contact with toe sliding surfaces 380*a*, 380*b*. In turn, this contact drives toe 316 downward toward baseplate 352 (see FIG. 11) causing pitch bearing surface 322 to be driven against pitch adjustment surface 324 (see FIG. 9). Consequently, aiming sight 304 is aligned to the pitch and yaw settings preserved in sight mount shoe 306, and may be repeatedly removed and aligned.

Figure 12:
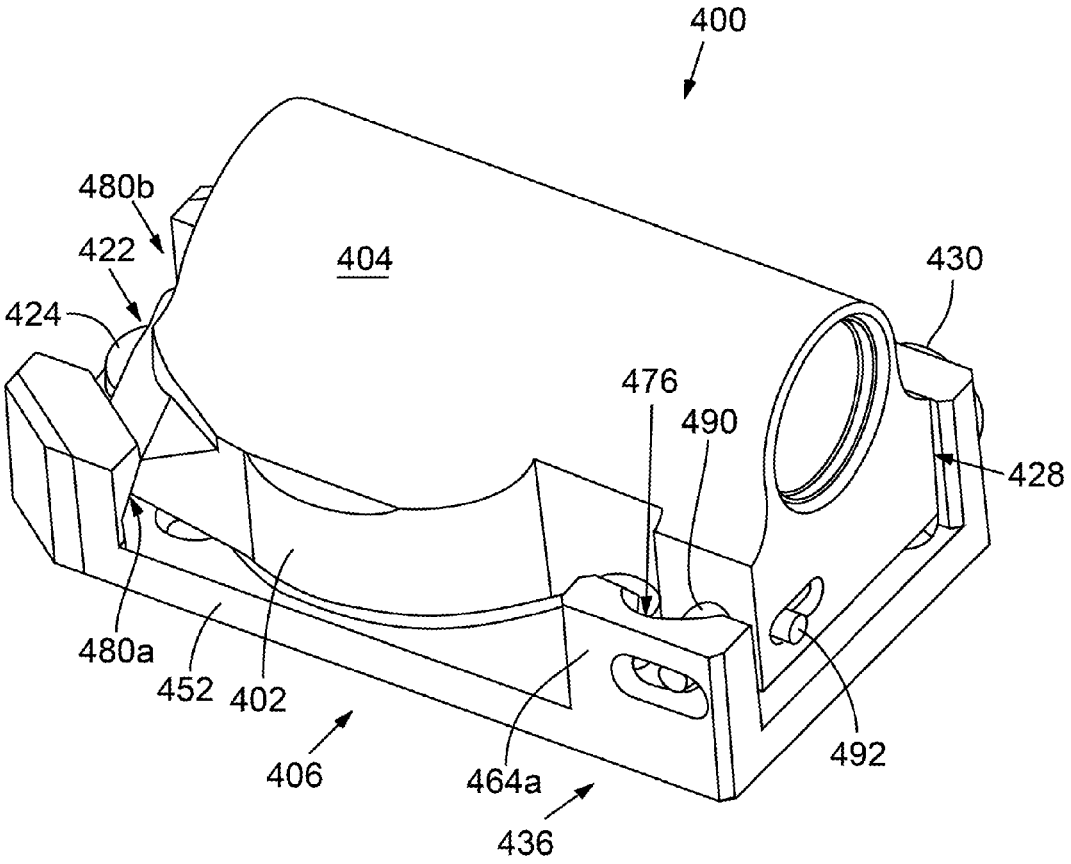
FIG. 12 is a top perspective view of another embodiment of a sight mount system.

FIG. 12 is a top perspective view of another embodiment of a sight mount system 400. In FIG. 12, the reference numbers having the same final two digits as those in FIGS. 2-7, as preceded by the number "4," identify analogous structures. For example, reference number 402 in FIG. 12 identifies an aiming sight foot similar to aiming sight foot 202 in FIG. 2. Accordingly, some detail of these structures may not be further described to avoid obscuring more pertinent aspects of the embodiment.

In the embodiment shown in FIG. 12, a captive slidable foot retainer 436 has a contoured pin 490 extending from aiming sight foot 402 toward a force direction surface 476 recessed into sidewall 464*a*. Foot retainer 436 includes an actuator 492 operatively coupled with pin 490 so that pin 490 may be moved back and forth laterally within aiming sight foot 402 relative to an aiming centerline of the shoe 406 when installed therein. A spring (not shown) within aiming sight foot 402 urges pin 490 against force direction surface 476 to bias foot retainer 436 away from aiming sight foot 402.

When aiming sight foot 402 is installed on sight mount shoe 406, the spring forces foot retainer 436 against force direction surface 476 so that foot retainer 436 drives yaw bearing surface 428 against yaw adjustment mechanism 430. The lateral force also pushes toe 416 into contact with toe sliding surfaces 480*a*, 480*b*. This contact drives toe 416 downward toward baseplate 452, causing pitch bearing surface 422 to be driven against pitch adjustment surface 424. Consequently, aiming sight 404 is aligned to the pitch and yaw settings preserved in sight mount shoe 406, and may be repeatedly removed and aligned.

Figure 13:
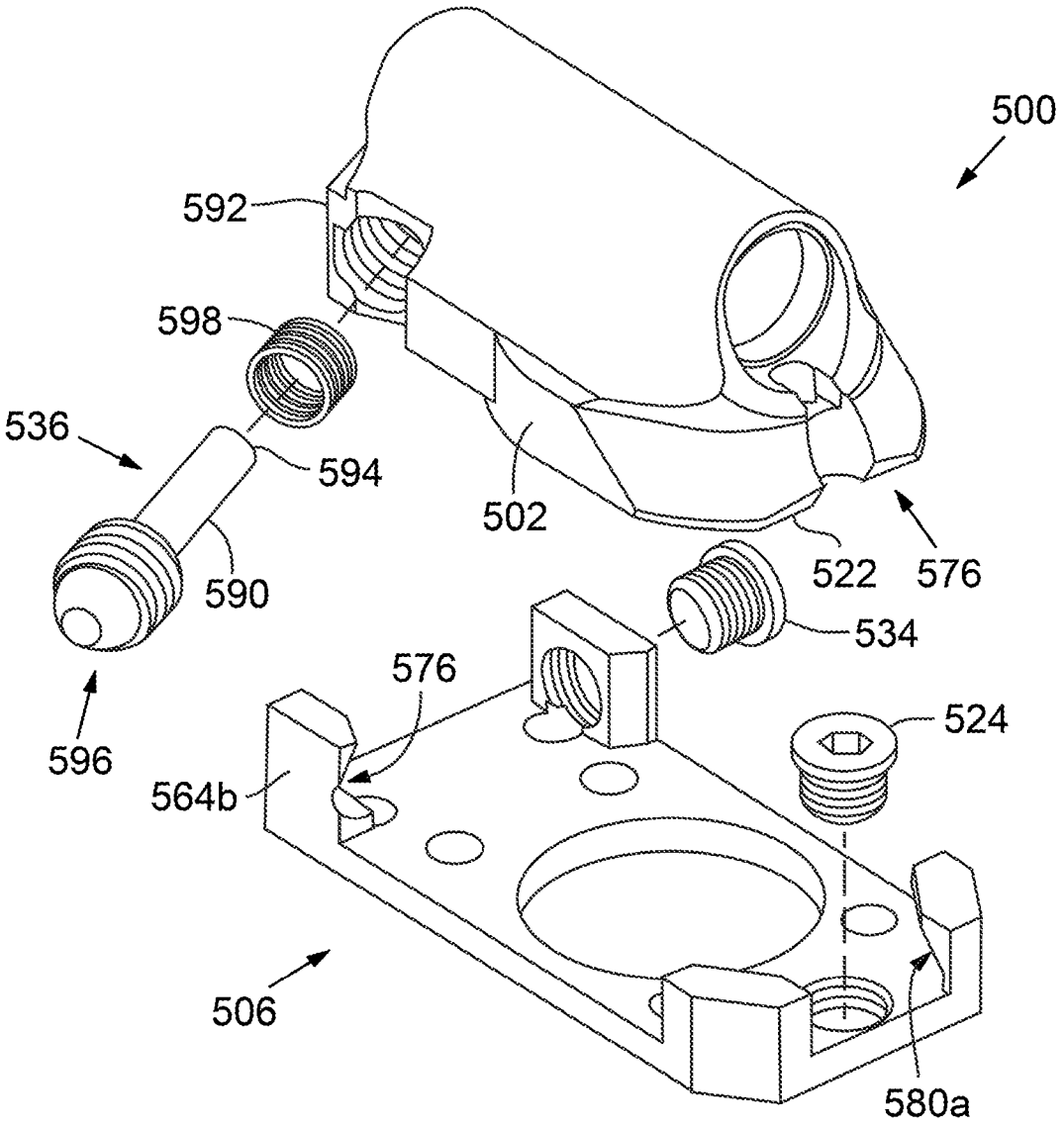
FIG. 13 is an exploded front perspective view of another embodiment of a sight mount system.
Figure 14:
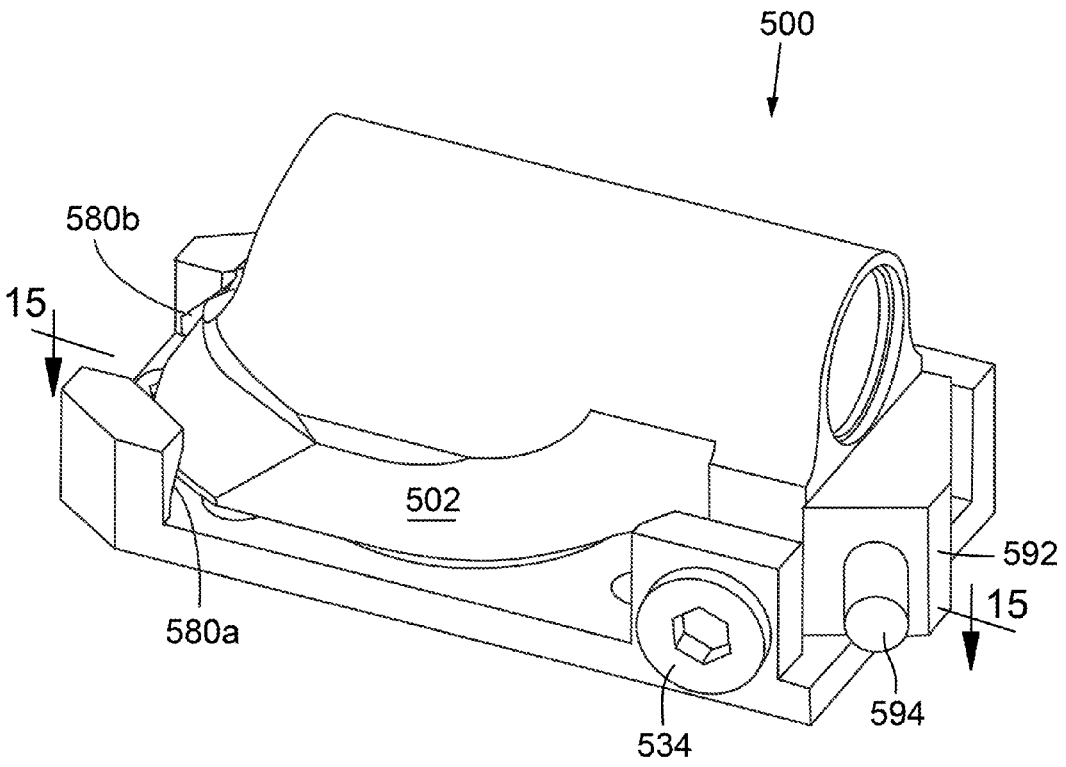
FIG. 14 is a rear perspective view of the embodiment shown in FIG. 13.
Figure 15:
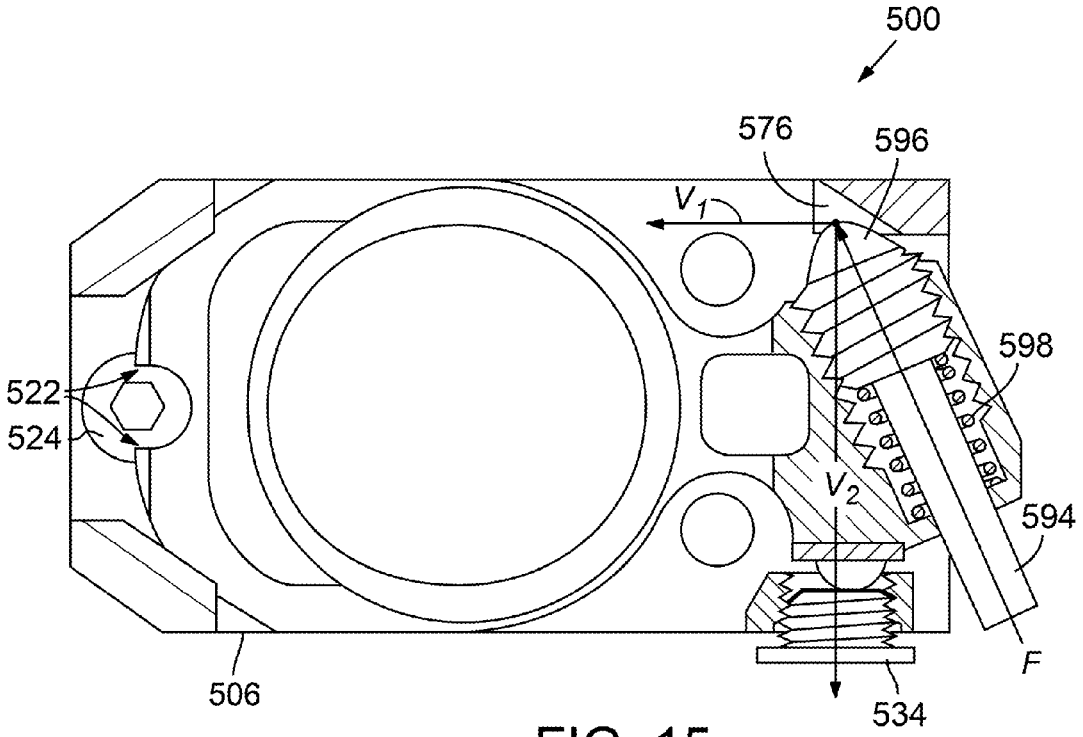
FIG. 15 is a top sectional view taken along line 15-15 of the embodiment shown in FIG. 14.
Figure 16:
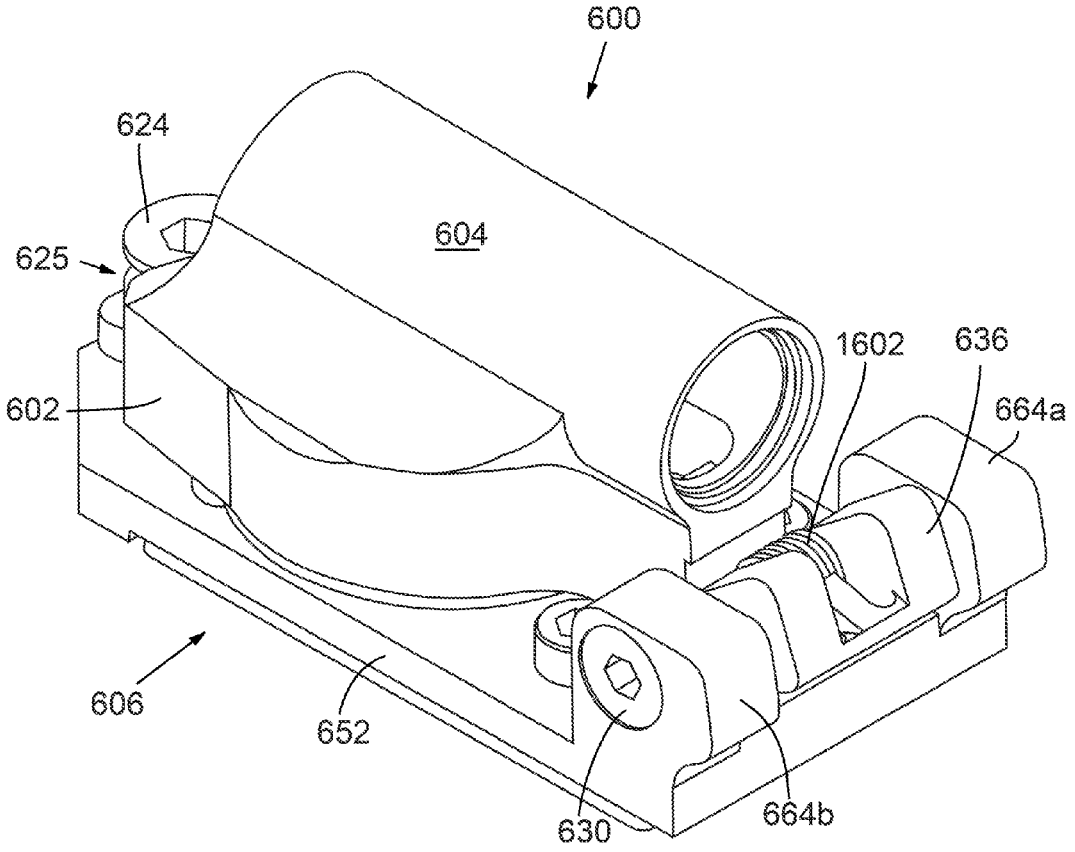
FIG. 16 is a rear perspective view of another embodiment of a sight mount system.

FIGS. 13-15 collectively illustrate another embodiment of a sight mount system 500. In FIGS. 13-15, the reference numbers having the same final two digits as those in FIGS. 2-7, as preceded by the number "5," identify analogous structures. For example, reference number 502 in FIG. 13 identifies an aiming sight foot similar to aiming sight foot 202 in FIG. 2. Accordingly, some detail of these structures may not be further described to avoid obscuring more pertinent aspects of the embodiment.

With particular reference to FIGS. 13 and 15, aiming sight foot 502 includes a foot retainer 536 that locks aiming sight foot 502 into sight mount shoe 506, so that the pitch and yaw settings may not be adjusted without first loosening foot retainer 536. Foot retainer 536 includes a shaft 590 threaded into a bearing block 592 of aiming sight foot 502. An adjustment end 594 of shaft 590 extends from a rear of bearing block 592 and is configured to be turned by a user to tighten or loosen the retainer and lock or unlock the foot 502 in the shoe 506. In some embodiments, adjustment end 594 may include a knob, knurling, or indentations to receive an adjustment tool. A convex shoe engagement end 596, located on shaft 590 opposite from adjustment end 594, is configured to mate with a force direction surface 576. Force direction surface 576 is recessed into sidewall 564*b*, and exhibits a concave shape that complements the shape of shoe engagement end 596. In some embodiments, a take-up spring 598 may be located on shaft 590 within bearing block 592 to urge foot retainer 536 against the threads inside bearing block 592.

With reference to FIGS. 13-15, when aiming sight foot 502 is installed on sight mount shoe 506 and shoe engagement end 596 is tightened against force direction surface 576, force direction surface 576 cooperates with foot retainer 536 to transform the force applied by shaft 590 into at least two force vectors (shown as $V_1$ and $V_2$). One force vector ($V_1$) is directed forward to press toe 516 against toe sliding surfaces 580*a*, 580*b* (see FIG. 14) and driving a pitch bearing surface 522 present on the foot against a pitch adjustment mechanism 524. Another force vector ($V_2$) is directed orthogonally to the first vector to force yaw bearing surface 528 against yaw adjustment mechanism 530. In turn, aiming sight 504 is aligned to the pitch and yaw settings preserved in sight mount shoe 506, and may be repeatedly removed and aligned. installing bolts 256 in baseplate 252 to connect the weapon to sight mount shoe 206

FIGS. 16-19 collectively illustrate another embodiment of a sight mount system 600. In FIGS. 16-19, the reference numbers having the same final two digits as those in FIGS. 2-7, as preceded by the number "6," identify analogous structures. For example, reference number 602 in FIG. 16 identifies an aiming sight foot similar to aiming sight foot 202 in FIG. 2. Accordingly, some detail of these structures may not be further described to avoid obscuring more pertinent aspects of the embodiment. In the embodiment shown in FIGS. 16-19, an aiming sight foot retainer 636 couples aiming sight foot 602 to sight mount shoe 606, which is in turn coupled to a projectile weapon via bolts 656. Foot retainer 636 is retained by yaw adjustment mechanism 630 in a space formed between sidewalls 664 of sight mount shoe 606.

In the embodiment shown in FIGS. 16-19, foot retainer 636 is biased about yaw adjustment mechanism 630 by a torsion spring 1602 which extends on a portion of yaw adjustment mechanism 630 and engages coaxially therewith, to urge the foot retainer 636 against a rearward portion of aiming sight foot 602 via the force applied by torsion spring 1602. A ball-shaped coupling 623*a* (see FIG. 17) occupies a space formed between a slot 1604 in foot retainer 636 and yaw bearing surface 628. Ball-shaped coupling 623*a* transmits to aiming sight foot 602 the spring force applied to foot retainer 636 by torsion spring 1602, which drives aiming sight foot 602 forward so that toe 616 couples with sight mount shoe 606 via one or more additional ball-shaped couplings 623*b*, 623*c* (see FIGS. 17-19), retaining the foot within the shoe 606. Consequently, aiming sight 604 is aligned to the pitch and yaw settings preserved in sight mount shoe 606, and may be repeatedly removed, installed, and aligned.

Figure 17:
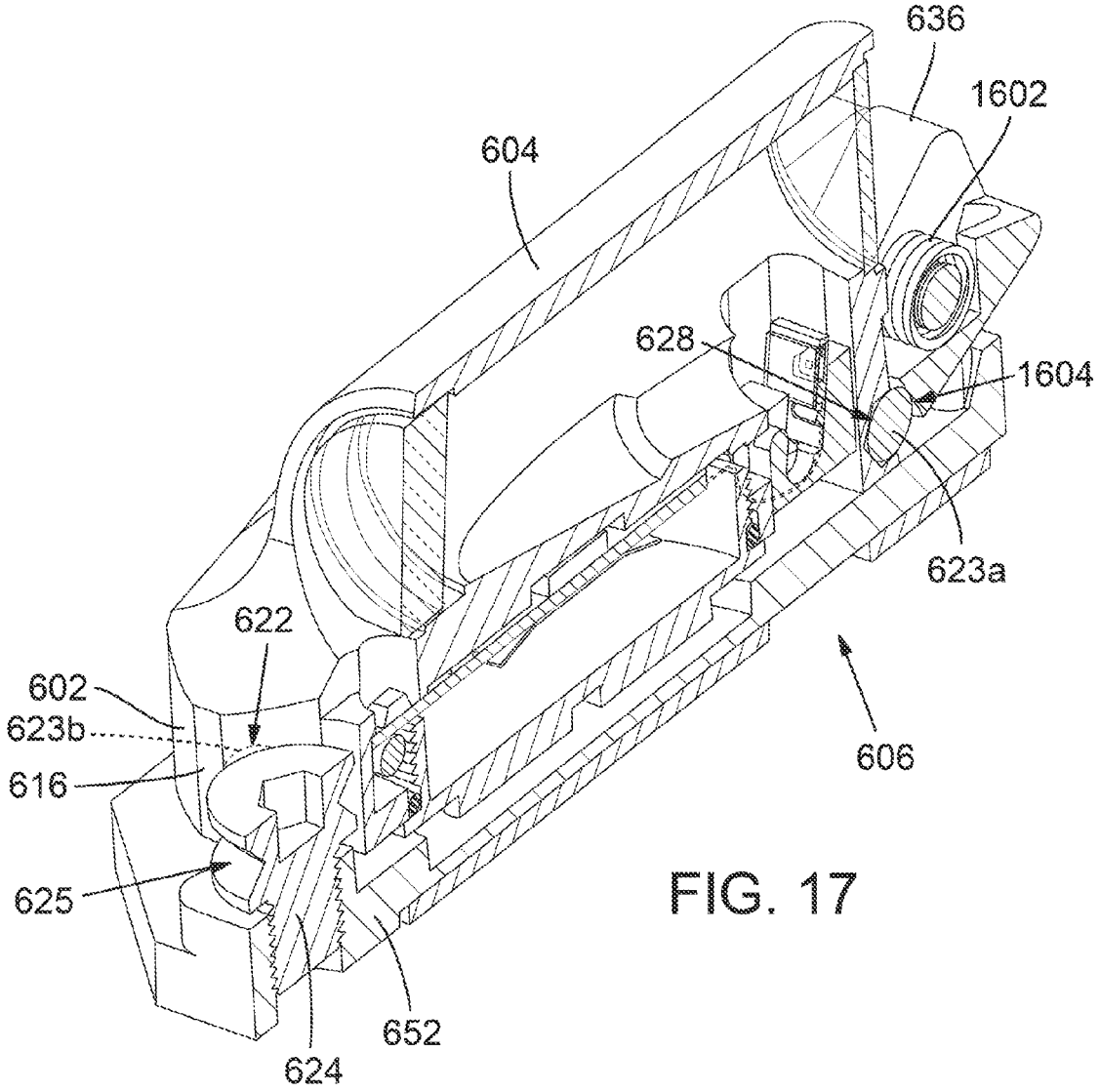
FIG. 17 is a perspective sectional view of the embodiment shown in FIG. 16.
Figure 18:
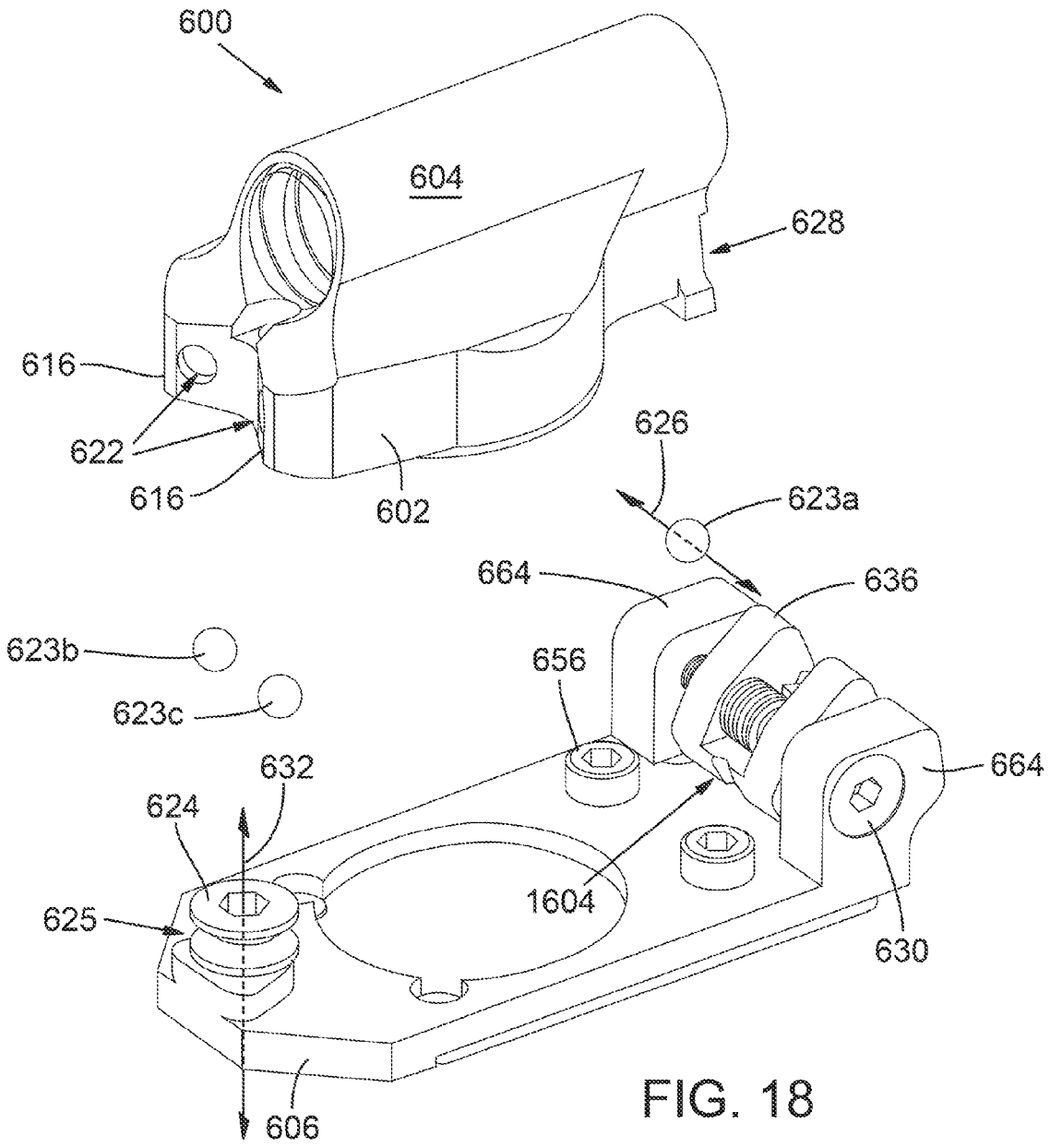
FIG. 18 is an exploded rear perspective view of the embodiment shown in FIG. 16.
Figure 19:
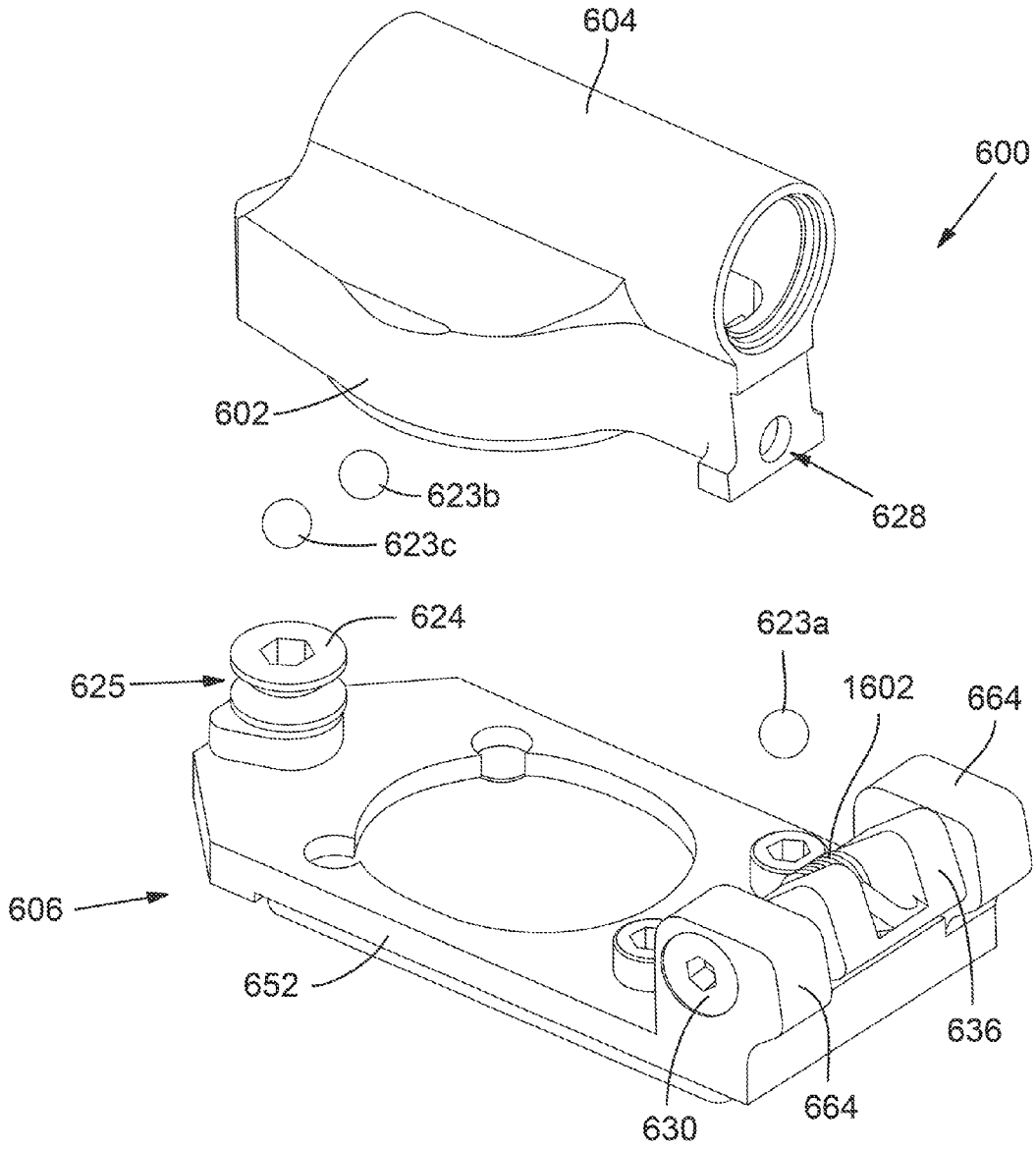
FIG. 19 is an exploded front perspective view of the embodiment shown in FIG. 16.

In the embodiment shown in FIGS. 16-19, the ball-shaped couplings 623 also provide locations where aiming sight foot 602 may move relative to sight mount shoe 606. Cooperation between the curved surfaces of the ball-shaped couplings 623 and the respective yaw and pitch bearing surfaces 628, 622 permits the foot to slide relative to the shoe so that the pitch and yaw of aiming sight foot 602 may be adjusted after installation in the shoe. For example, with particular reference to FIG. 17, ball-shaped couplings 623*b*, 623*c* are inserted into and bear against pocket-shaped pitch bearing surfaces 622. A portion of each of the ball-shaped couplings 623*b*, 623*c* extends out of the pitch bearing surfaces 622 and sit against and ride in a recessed groove or channel 625 formed on and encircling an exterior surface of the pitch adjustment mechanism 624. As illustrated in FIG. 17, the pitch adjustment mechanism 624 threadably engages the baseplate 652 so that rotational movement of the pitch adjustment mechanism 624 moves the threaded lower portion of the pitch adjustment mechanism 624 into or out of the baseplate 652. When the pitch adjustment mechanism 624 is adjusted (e.g., the mechanism 624 is moved upward or downward relative to the baseplate 652), the adjustment force (or a portion thereof) is transmitted to the ball-shaped couplings 623*b*, 623*c* bearing against the channel 625. The ball-shaped couplings 623*b*, 623*c* in turn are driven against the pitch bearing surfaces 622, which transmits the adjustment force (or a portion thereof) to the pitch bearing surfaces 622 of toe 616, thereby pitching the aiming sight foot 602 upward or downward about a pitch axis 626 that passes horizontally through ball-shaped coupling 623*a*.

A similar approach may be used to adjust the yaw of the sight. Translation of yaw adjustment mechanism 630 in and out of sidewalls 664 adjusts the yaw of aiming sight foot 602. Force applied to ball-shaped coupling 623*a* by yaw adjust mechanism 630 is transmitted to yaw bearing surface 628 and causes ball-shaped couplings 623*b*, 623*c* to roll or ride within groove 625 of the pitch adjustment mechanism 624. In turn, toe 616 pivots about a yaw axis 632 that passes vertically through pitch adjustment mechanism 624 (e.g., along a central axis of the pitch adjustment mechanism). It should be understood that movement of the yaw adjustment mechanism alone may result in adjustment about the yaw axis without disturbing the connection between the pitch bearing surface and the pitch adjustment mechanism. Accordingly, aiming sight foot 602 may maintain contact with the adjustment mechanisms under the urging of foot retainer 636 and the cooperative relationships described herein so that aiming sight 604 may be moved about either axis independently or together.

While the example sight mount systems described herein have generally been shown and described in the context of pistols or handguns, it will be appreciated that any of the embodiments may be employed with other suitable projectile weapons. For example, FIGS. 20-23 collectively show another embodiment of a sight mount system 700 for use with a grenade launcher 2001. In FIGS. 20-23, the reference numbers having the same final two digits as those in FIGS. 2-7, as preceded by the number "7," identify analogous structures. For example, reference number 702 in FIG. 20 identifies an aiming sight foot similar to aiming sight foot 202 in FIG. 2. Accordingly, some detail of these structures may not be further described to avoid obscuring more pertinent aspects of the embodiment. In the embodiment shown in FIGS. 20-23, an aiming sight foot retainer 736 couples aiming sight foot 702 to sight mount shoe 706. Foot retainer 736 retained by yaw adjustment mechanism 730 in a space formed between sidewalls 764 of sight mount shoe 706.

In the embodiment shown in FIGS. 20-23, sight mount system 700 is mounted to an adjustable base 2000, which is mounted to a grenade launcher 2001 via a locking slide mount 2101. Locking slide mount 2101 includes vertically oriented tangs 2102 which slidably engage with recessed pockets 2003 formed on an upper surface of grenade launcher 2001. Locking slide mount 2101 also includes horizontally oriented projections 2104 extending outwardly from an arm 2103, which are mounted to or engaged with recesses 2004 formed on side surfaces of the grenade launcher 2001. To affix the adjustable base 2000 onto grenade launcher 2001, the tangs 2102 are slidably engaged within the pockets 2003 and the projections 2104 are secured to recesses 2004 via screws, bolts, or other suitable fasteners. In some embodiments, the sight mount system 700 may include a latching or locking mechanism that secures the sight mount system 700 in position on the adjustable base 2000. The latching or locking mechanism may include a hook or other arm extending from the sight mount system 700 and engaging a lip or other feature of the adjustable base 2000. In such embodiments, the latching or locking mechanism must be first be disengaged prior to removing the sight mount system 700.

Adjustable base 2000 includes an elevation adjustment 2002 that, in some embodiments, is capable of adjusting an elevation of sight mount system 700 relative to grenade launcher 2001 of between 0 and 45 degrees. In other embodiments, elevation adjustment 2002 may be capable of up to 60 degrees of elevation adjustment. Accordingly, as described in more detail below, elevation adjustment 2002 may provide a greater range of pitch adjustment when compared to the pitch adjustment included in sight mount system 700.

Figure 20:
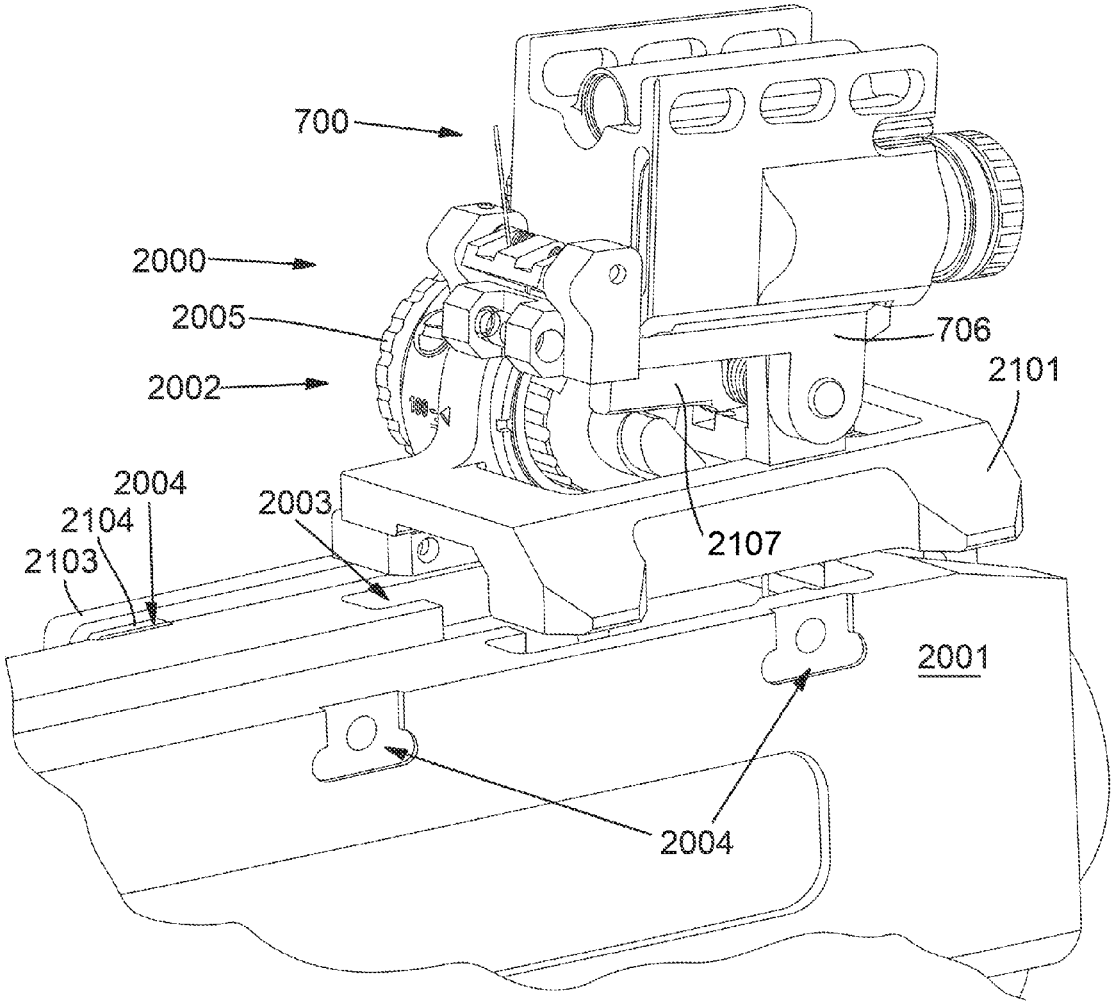
FIG. 20 is a front perspective view of another embodiment of a sight mount system shown mounted to a projectile weapon.
Figure 21:
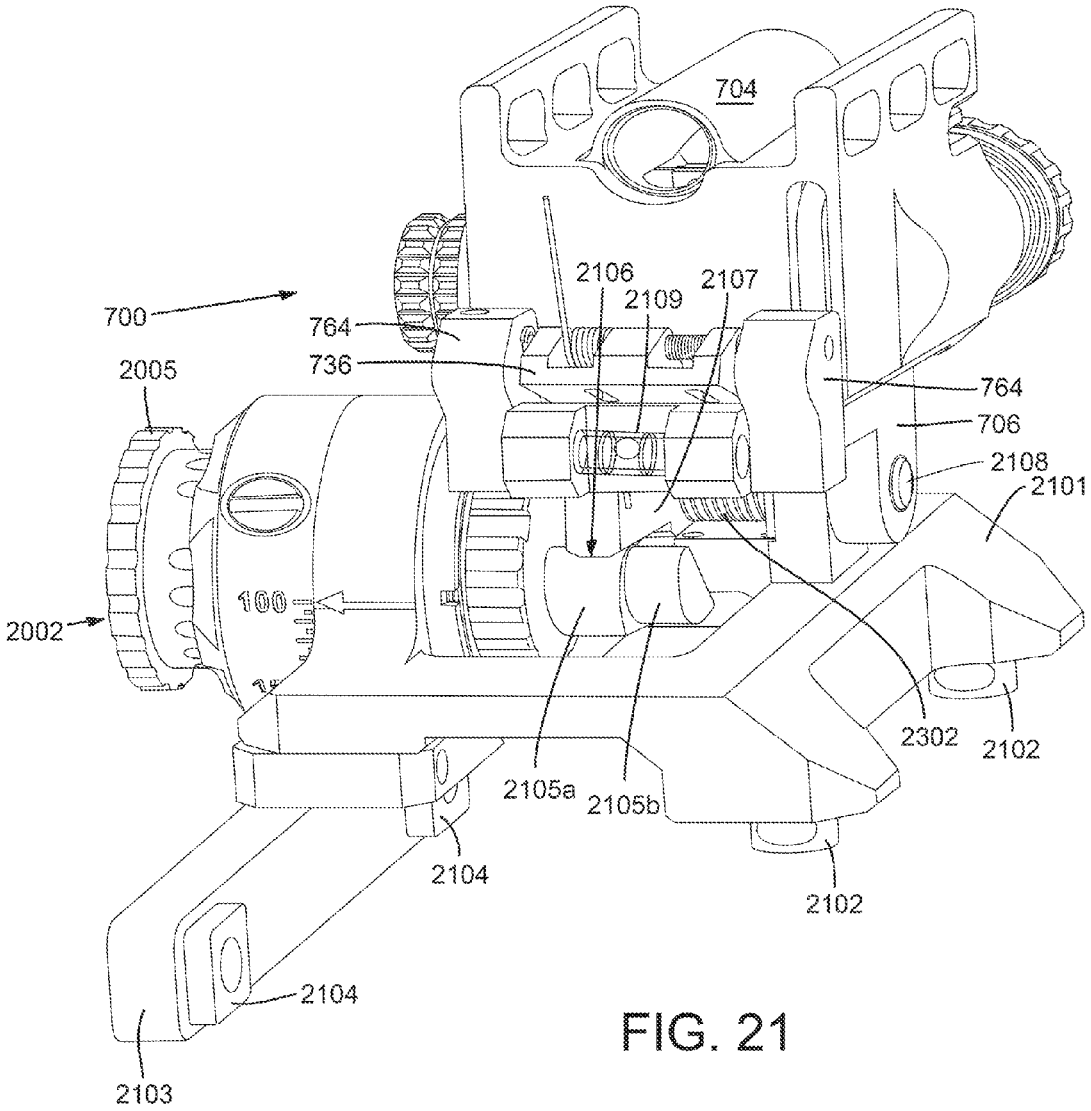
FIG. 21 is another front perspective view of the embodiment shown in FIG. 20.
Figure 22:
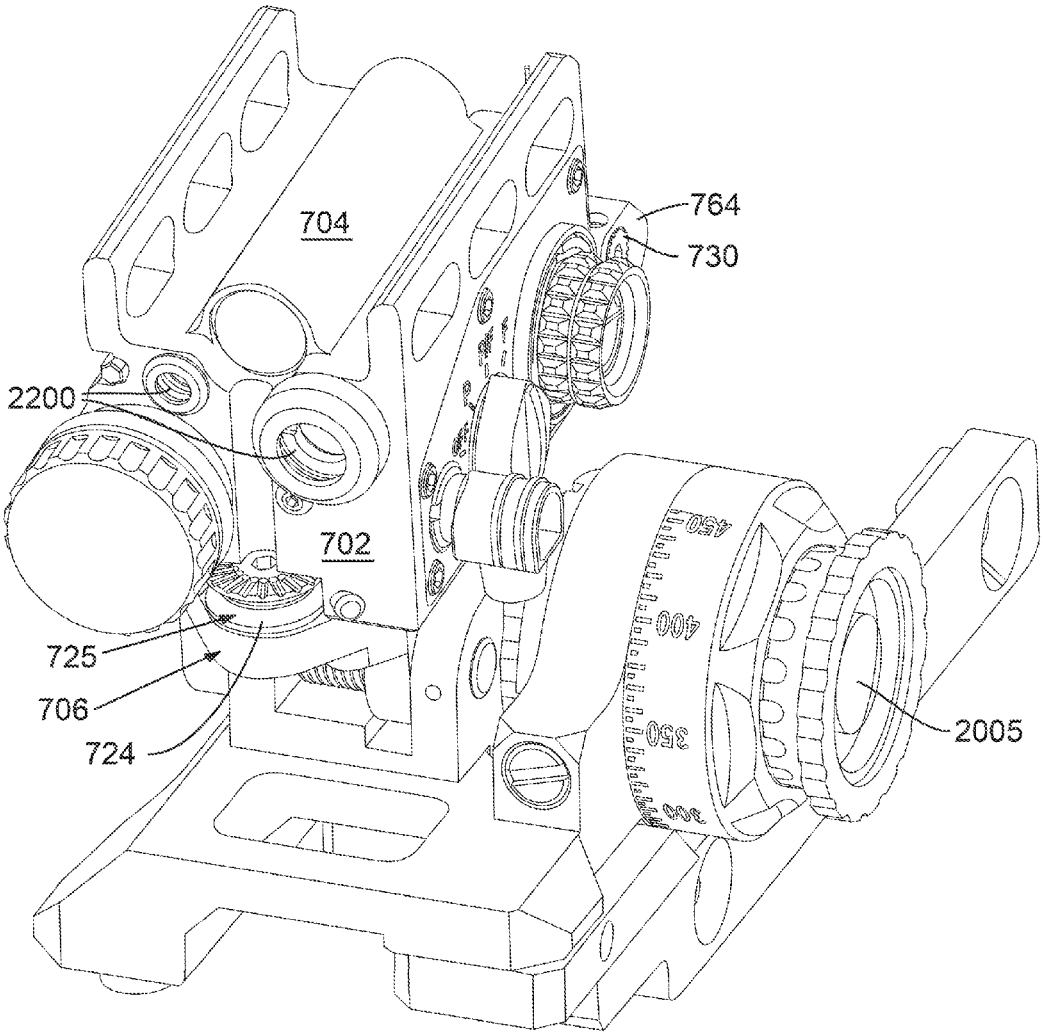
FIG. 22 is a rear perspective view of the embodiment shown in FIG. 20.
Figure 23:
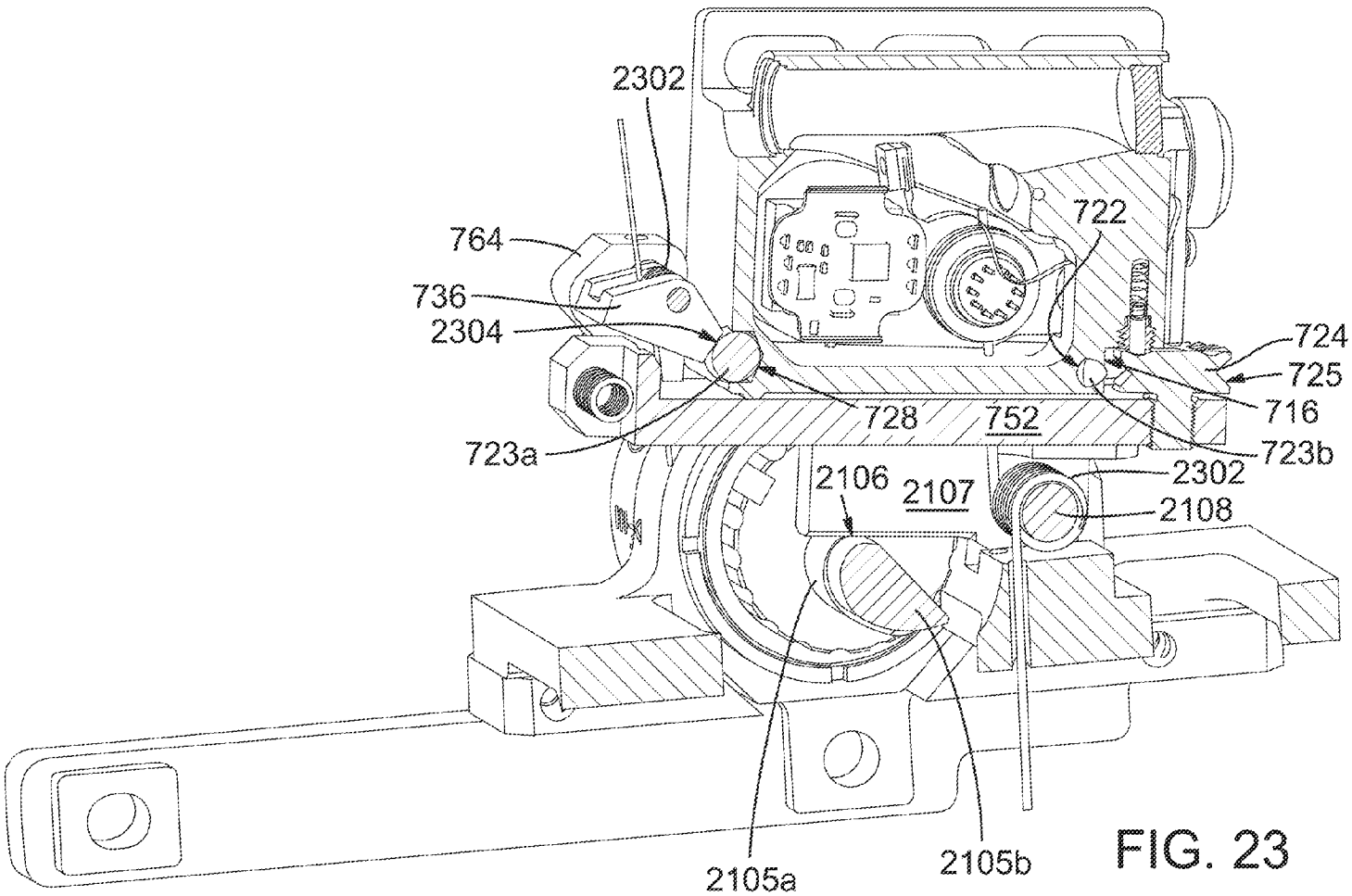
FIG. 23 is a perspective sectional view of the embodiment shown in FIG. 21.

With reference to FIGS. 20 and 21, the following section describes additional details of the elevation adjustment 2002 of the adjustable base 2000. With particular reference to FIG. 21, rotation of knob 2005 about a rotational axis (not shown) causes cam lobes 2105*a*, 2105*b* to rotate about the rotational axis (adjacent to axle 2108) and relative to an adjustment bearing surface 2106 formed on a projection 2107 extending downward from an underside of sight mount shoe 706. In turn, adjustment bearing surface 2106 follows the rotation of the profiled surface of one of cam lobes 2105*a*, 2105*b*, adjusting an angle formed between sight mount shoe 706 and locking slide mount 2101. A torsion spring 2302 extends along a portion of axle 2108 and engages coaxially therewith, so that projection 2107 is urged downward against one of cam lobes 2105*a*, 2105*b*. Forcing projection 2107 downward against one of the cam lobes 2105*a*, 2105*b*, instead of biasing sight mount shoe 706 upwards, may provide the potentially beneficial large elevation adjustments (e.g., 45 degrees or more) described herein, and may also potentially stabilize sight mount system 700 against weapon recoil.

Preferably, cam lobes 2105*a*, 2105*b* exhibit different surface profiles. In the embodiment shown in FIGS. 20-23, cam lobe 2105*b* includes a contoured surface generally having a smaller curvature relative to cam lobe 2105*a*. Consequently, the elevation change in sight mount shoe 706 when projection 2107 follows cam lobe 2105*b* for a given amount of rotation of knob 2005 is expected to be greater than the elevation change resulting when projection 2107 follows cam lobe 2105*a* (for the same rotation of knob 2005). Accordingly, changing from one cam lobe to another results in variation in the degree of elevation change in sight mount shoe 706 per degree of rotation of knob 2005. Such variation may be selected according to a ballistic profile of the projectile. As a non-limiting example, one lobe may be configured to adjust elevation for use with a high explosive projectile while a different lobe may be configured to make an elevation adjustment for a non-explosive projectile. In some embodiments, knob 2005 may be pulled (or pushed) along its axis of rotation (i.e., translated along the axis of rotation) to change engagement of the projection 2107 from cam lobe 2105*a* to 2105*b* (or the reverse).

In some embodiments, a visual indication of the extent of elevation adjustment may be provided (e.g., visually identifiable markings located about knob 2005) so that a user is able to identify the extent of elevation adjustment 2002. In some embodiments, other visual indications of an offset formed between elevation adjustment 2002 and a reference plane may be provided. For example, the embodiment shown in FIGS. 20-23 includes a bubble level 2109 formed in sight mount shoe 706 to indicate tilting about a roll axis (e.g., an axis extending parallel to a boreline axis of grenade launcher 2001). Bubble level 2109 may include a spirit level or may include some visual indication of a virtual bubble (e.g., a marking depicted on a display or screen).

In the embodiment shown in FIGS. 20-23, foot retainer 736 is biased about yaw adjustment mechanism 730 by a torsion spring 1702 which extends around a portion of yaw adjustment mechanism 730 and engages coaxially therewith, so that foot retainer 736 is urged forward against a rearward portion of aiming sight foot 702. A ball-shaped coupling (FIG. 23 at 723*a*) occupies a space formed between a slot 2304 in foot retainer 736 and yaw bearing surface 728. Ball-shaped coupling 723*a* transmits to aiming sight foot 702 the spring force applied to foot retainer 736 by torsion spring 1702. In turn, aiming sight foot 702 is driven forward so that toe 716 couples with sight mount shoe 706 via one or more additional ball-shaped couplings (FIG. 23 at 723*b*), retaining the foot within the shoe. Consequently, aiming sight 704 is aligned to the pitch and yaw settings preserved in sight mount shoe 706, and may be repeatedly removed, installed, and aligned.

In the embodiment shown in FIGS. 20-23, the ball-shaped couplings also provide locations where aiming sight foot 702 may move relative to sight mount shoe 706. Cooperation between the curved surfaces of the ball-shaped couplings and the yaw and pitch bearing surfaces (728 and 722, respectively) permits the foot to slide relative to the shoe so that the pitch and yaw of aiming sight foot 702 may be adjusted after installation in the shoe. For example, translation of pitch adjustment mechanism 724 in and/or out of baseplate 752 adjusts the pitch of aiming sight foot 702. A groove 725 located on an outer surface of pitch adjustment mechanism 724 bears against one or more ball-shaped couplings (e.g., FIG. 23 at 723*b*) which transmit the adjustment force to pocket-shaped pitch bearing surfaces 722 included in toe 716. In turn, aiming sight foot 702 will pitch up or down about a pitch axis. For example, in some embodiments, the pitch axis may pass horizontally through ball-shaped coupling 723*a*.

A similar approach may be used to adjust the yaw of the sight. Translation of yaw adjustment mechanism 730 in and out of sidewalls 764 adjusts the yaw of aiming sight foot 702. Force applied to ball-shaped coupling 723*a* by yaw adjust mechanism 730 is transmitted to yaw bearing surface 728 and causes ball-shaped couplings (e.g., FIG. 23 at 723*b*) to roll within groove 725 included in pitch adjustment mechanism 724. In turn, toe 716 pivots about a yaw axis. In some embodiments, toe 716 may pivot about a yaw axis that passes vertically through pitch adjustment mechanism 724 (e.g., along a central axis of the pitch adjustment mechanism). Of course, it will be understood that movement of the yaw adjustment mechanism alone may result in adjustment about the yaw axis without disturbing the connection between the pitch bearing surface and the pitch adjustment mechanism. Accordingly, aiming sight foot 702 may maintain contact with the adjustment mechanisms under the urging of foot retainer 736 and the cooperative relationships described herein so that aiming sight 704 may be moved about either axis independently or together.

In some embodiments, aiming sight mechanism 700 may include one or more secondary sighting channels. The embodiment of aiming sight mechanism 700 shown in FIGS. 20-23 includes visible and infrared lasers 2200 (see FIG. 22). These secondary sighting channels are integrated with aiming sight foot 702. Consequently, adjustment of the pitch and/or yaw causes these secondary sighting channels to move with aiming sight 704, so that the secondary sighting channels need not be independently adjusted (or re-sighted) upon installation or re-installation of the aiming sight mechanism 700. In addition, not only does the aiming sight mechanism 700 retain zero as it is installed and reinstalled, but multiple sights may be installed on multiple weapons without losing zero on any weapon. In such embodiments, the sights may require alignment via a master fixture or structure to ensure that the sights are aligned relative to one another.

The various embodiments disclosed herein may be formed from a variety of materials. For example, embodiments of the aiming sight foot, the sight mount shoe, and the foot retainer may be fabricated, plated, or reinforced with aluminum or steel (e.g., a corrosion-resistant variety of steel), though these examples are not intended to be limiting. Embodiments of the pitch and yaw adjustment mechanisms may be fabricated, plated, or reinforced with a wear and/or corrosion resistant material (e.g., stainless steel), as may embodiments of the pitch and yaw bearing surfaces.

In some embodiments, one or more elements described herein may be formed, coated, or reinforced with a suitable polymer. For example, a rigid polymer may be included as an electrical or thermal standoff in some structures, or an elastic polymer may be included as a shock absorber in some structures, depending on the application. In some embodiments, one or more of the sliding surfaces or bearing surfaces may include a layer or a coating of a slippery material having a coefficient of friction lower than that of polished steel, such as polytetrafluoroethylene (PTFE) or aluminum magnesium boride (BAM). Naturally, various elements and structures used in the embodiments described herein may be fabricated by, among other methods, casting, machining, molding, pressing, and/or three-dimensional printing, or by some combination thereof.

It will be obvious to those having skill in the art that many changes may be made to the details of the above-described embodiments without departing from the underlying principles of the invention. The scope of the present invention should, therefore, be determined only by the following claims.

The invention claimed is:

1. A system for removably coupling and adjusting a sight mount on a grenade launcher, the system comprising:

a sight mount for supporting an aiming sight, the sight mount configured for being secured to a grenade launcher, wherein the sight mount includes pitch and yaw adjustment mechanisms operable for selectively adjusting the pitch and yaw of the aiming sight;

a foot retainer configured to urge the aiming sight into contact with the pitch and yaw adjustment mechanisms, the foot retainer manually operable to enable the aiming sight to be removed and reinstalled on the sight mount without disturbing the pitch and yaw adjustment mechanisms, to thereby preserve the aiming alignment established by the pitch and yaw adjustment mechanisms; and a base including an attachment mechanism extending therefrom, the attachment mechanism slidably engageable with a catch formed on a surface of the grenade launcher to secure the sight mount and adjustable base to the grenade launcher.

2. The system of claim 1, wherein the base further includes an elevation adjustment mechanism operable to adjust an elevation setting of the sight mount relative to the grenade launcher.

3. The system of claim 2, further including a cam mechanism in operable communication with the sight mount, and an adjustment knob in operable communication with the cam mechanism for driving the cam mechanism to adjust the pitch of the aiming sight.

4. The system of claim 3, wherein the cam mechanism includes a first cam lobe with a first contour surface having a first radius of curvature, and a second cam lobe with a second contour surface having a second radius of curvature, wherein the first radius of curvature is different than the second radius of curvature, and wherein the sight mount further includes a projection arm riding against one of the first or second cam lobes, wherein a rate of adjustment of the aiming sight changes per degree of rotation of the adjustment knob based on whether the arm is riding against the first cam lobe or the second cam lobe.

5. The system of claim 4, wherein the adjustment knob is translatable along its axis of rotation to toggle engagement of the projection arm between the first and second cam profiles.

6. The system of claim 2, wherein the elevation adjustment mechanism is operable to adjust the elevation setting of the sight mount up to 60 degrees.

7. The system of claim 1, the sight mount further including an elevation adjustment indicator for visually identifying an elevation adjustment setting.

8. The system of claim 1, wherein the foot retainer is biased about the yaw adjustment mechanism by a biasing element extending around a portion of the yaw adjustment mechanism and engaging coaxially therewith.

9. The system of claim 8, further comprising a coupling occupying a space formed between a slot in the foot retainer and a yaw bearing surface, the coupling transmitting to the aiming sight a biasing force applied to the foot retainer by the biasing element, the biasing force driving the aiming sight forwardly into the sight mount.

10. The system of claim 1, wherein the aiming sight further includes a secondary sighting mechanism.

11. The system of claim 10, wherein the secondary sighting mechanism is a laser.

* * * * *